US011624515B2

(12) United States Patent
Xing et al.

(10) Patent No.: US 11,624,515 B2
(45) Date of Patent: Apr. 11, 2023

(54) CHASSIS FOR WINDOW AIR CONDITIONER, CHASSIS ASSEMBLY, AND WINDOW AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventors: Zhigang Xing, Foshan (CN); Kangwen Zhang, Foshan (CN); Hui Yu, Foshan (CN); Yu Liu, Foshan (CN); Jing Tan, Foshan (CN); Ali Zhao, Foshan (CN); Jianping Meng, Foshan (CN); Yuhang Tang, Foshan (CN); Wenjun Shen, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 222 days.

(21) Appl. No.: 16/900,428

(22) Filed: Jun. 12, 2020

(65) Prior Publication Data

US 2021/0199312 A1 Jul. 1, 2021

Related U.S. Application Data

(63) Continuation of application No. PCT/CN2020/077603, filed on Mar. 3, 2020.

(30) Foreign Application Priority Data

Dec. 31, 2019 (CN) ..... 201911423774.4
Dec. 31, 2019 (CN) ..... 201922500873.X
(Continued)

(51) Int. Cl.
*F24F 1/031* (2019.01)
*F24F 1/0323* (2019.01)
(Continued)

(52) U.S. Cl.
CPC ..... *F24F 1/031* (2019.02); *F24F 1/027* (2013.01); *F24F 1/0323* (2019.02); *F24F 13/222* (2013.01)

(58) Field of Classification Search
CPC .. F24F 13/224; F24F 2013/202; F24F 1/0284; F24F 1/029; F24F 13/222;
(Continued)

(56) References Cited

U.S. PATENT DOCUMENTS 3,448,590 A * 6/1969 Eberhart ..... F24F 1/031 62/262
5,081,849 A 1/1992 Thompson et al.
(Continued)

FOREIGN PATENT DOCUMENTS

CN 201575564 U * 9/2010
CN 201575564 U 9/2010
(Continued)

OTHER PUBLICATIONS

CN-201575564-U Translation (Year: 2010).*
(Continued)

*Primary Examiner* — Schyler S Sanks
(74) *Attorney, Agent, or Firm* — Anova Law Group PLLC

(57) ABSTRACT

A chassis for a window air conditioner includes an indoor part and an outdoor part arranged along a length direction of the chassis. The indoor part includes an air inlet hole at a bottom wall of the indoor part. The air inlet hole penetrates the chassis in a thickness direction of the indoor part.

20 Claims, 27 Drawing Sheets

(30) Foreign Application Priority Data

| | | |
|---|---|---|
| Dec. 31, 2019 | (CN) | 201922500934.2 |
| Dec. 31, 2019 | (CN) | 201922501095.6 |
| Dec. 31, 2019 | (CN) | 201922501518.4 |
| Dec. 31, 2019 | (CN) | 201922501555.5 |

(51) Int. Cl.
*F24F 13/22* (2006.01)
*F24F 1/027* (2019.01)

(58) Field of Classification Search
CPC ..... F24F 1/027; F24F 1/0323; F24F 1/031; F25B 40/02
See application file for complete search history.

(56) References Cited

U.S. PATENT DOCUMENTS

| | | | | |
|---|---|---|---|---|
| 2016/0131370 | A1* | 5/2016 | Wong | F24F 1/027 454/201 |
| 2018/0100674 | A1* | 4/2018 | Eicher | F24F 1/027 |

FOREIGN PATENT DOCUMENTS

| | | | | | |
|---|---|---|---|---|---|
| CN | 101871678 | A | | 10/2010 | |
| CN | 101893288 | A | | 11/2010 | |
| CN | 204786819 | U | | 11/2015 | |
| CN | 105333527 | A | * | 2/2016 | |
| CN | 207317119 | U | | 5/2018 | |
| CN | 108151288 | A | | 6/2018 | |
| CN | 207555797 | U | | 6/2018 | |
| CN | 108253550 | A | * | 7/2018 | |
| CN | 109724169 | A | | 5/2019 | |
| CN | 110068070 | A | | 7/2019 | |
| CN | 110375384 | A | * | 10/2019 | F24F 1/0063 |
| CN | 209689075 | U | | 11/2019 | |
| CN | 209763321 | U | | 12/2019 | |
| CN | 111006385 | A | | 4/2020 | |
| CN | 111023545 | A | | 4/2020 | |
| CN | 211345777 | U | | 8/2020 | |
| CN | 211345790 | U | | 8/2020 | |
| CN | 211400072 | U | | 9/2020 | |
| JP | 2003074903 | A | | 3/2003 | |
| WO | WO-2009036532 | A2 | * | 3/2009 | F24F 1/027 |
| WO | WO-2018111710 | A1 | * | 6/2018 | F24F 1/02 |

OTHER PUBLICATIONS

CN-108253550-A Translation (Year: 2018).*
CN-105333527-A Translation (Year: 2016).*
CN110375384A Translation (Year: 2019).*
World Intellectual Property Organization (WIPO) International Search Report and Written Opinion for PCT/CN2020/077603 with translation dated Sep. 29, 2020 26 Pages.

* cited by examiner

B–B

CHASSIS FOR WINDOW AIR CONDITIONER, CHASSIS ASSEMBLY, AND WINDOW AIR CONDITIONER

CROSS-REFERENCE TO RELATED APPLICATIONS

This application is a continuation of International Application No. PCT/CN2020/077603, filed on Mar. 3, 2020, which is based on and claims priority to Chinese Patent Application Nos. 201922501095.6, 201911423774.4, 201922500873.X, 201922501518.4, 201922501555.5, and 201922500934.2, all filed on Dec. 31, 2019, the entire contents of all of which are incorporated herein by reference.

FIELD

This application relates to a field of air conditioning technologies, and particularly to a chassis for a window air conditioner, a chassis assembly, and a window air conditioner.

BACKGROUND

In the related art, window air conditioners have a small air intake area, which affects the air input and air output of the window air conditioners and fails to meet the needs of users.

SUMMARY

The present disclosure provides a chassis for a window air condition, and the chassis has an advantage of a large air intake area.

The present disclosure also provides a chassis assembly including the above chassis.

The present disclosure also provides a window air conditioner that includes the above chassis.

The chassis according to embodiments of the present disclosure includes: an indoor part and an outdoor part arranged along a length direction of the chassis. A bottom wall of the indoor part includes an air inlet hole, and the air inlet hole penetrates the chassis in a thickness direction of the indoor part.

The chassis for the window air conditioner according to embodiments of the present disclosure is provided with the air inlet hole in the bottom wall of the indoor part, thus part of the indoor airflow may enter the window air conditioner through the air inlet hole of the indoor part, so that the air intake area of the window air conditioner may be enlarged, satisfying users' needs.

According to some embodiments of the present disclosure, the air inlet hole is formed as a long strip-shaped hole.

According to some embodiments of the present disclosure, an upper surface of the bottom wall of the indoor part is provided with an annular water blocking member, and the water blocking member is disposed around the air inlet hole.

According to some embodiments of the present disclosure, the outdoor part includes a drain hole and an overflow hole spaced apart from each other, and the overflow hole and the drain hole both penetrate the chassis.

According to some embodiments of the present disclosure, the overflow hole and the drain hole are arranged along the length direction of the chassis, and the drain hole is located at a side of the overflow hole away from the indoor part.

According to some embodiments of the present disclosure, a lower surface of the chassis includes an avoidance groove recessed upward, and the avoidance groove extends along the length direction of the chassis.

According to some embodiments of the present disclosure, an upper surface of a bottom wall of the outdoor part includes a mounting platform for mounting a compressor, a portion of the chassis protrudes upward to form a reinforcement rib, and the reinforcement rib extends in a peripheral direction of the mounting platform and is spaced apart from the mounting platform.

According to some embodiments of the present disclosure, in the peripheral direction of the mounting platform, the reinforcement rib surrounds a portion of the mounting platform.

According to some embodiments of the present disclosure, a portion of the chassis protrudes upward to form a connection rib, and one end of the connection rib is connected to the mounting platform, while the other end of the connection rib is connected to the reinforcement rib.

According to some embodiments of the present disclosure, the outdoor part includes a first water storage tank spaced apart from the mounting platform.

According to some embodiments of the present disclosure, the first water storage tank extends in a width direction of the chassis and extends from one end of the chassis in the width direction to the other end of the chassis in the width direction.

According to some embodiments of the present disclosure, the outdoor part includes a second water storage tank, the second water storage tank is provided at a side of the first water storage tank close to the indoor part, and the second water storage tank is in communication with the first water storage tank.

According to some embodiments of the present disclosure, in the width direction of the chassis, the second water storage tank is located at an end of the first water storage tank.

The chassis assembly according to embodiments of the present disclosure is used for a window air conditioner. The window air conditioner includes a back panel, a condenser, an evaporator, and a throttle device connected between the condenser and the evaporator. The chassis assembly includes: a chassis on which the condenser and the evaporator are to be provided, the chassis including an indoor part and an outdoor part, the outdoor part having a first water storage tank extending along a width direction of the chassis, and the back panel being provided on the outdoor part; a supercooling tube provided in the first water storage tank and having a first end and a second end. The first end is connected to an outlet of the condenser, the second end is connected to an inlet of the throttle device, and the first end and the second end are located at the same end of the chassis in the width direction. The supercooling tube extends from a first end of the chassis in the width direction to a second end of the chassis in the width direction and then bends back to the first end of the chassis in the width direction, and a portion of the supercooling tube close to the indoor part includes a bent segment that is bent toward the indoor part.

For the chassis assembly according to the embodiments of the present disclosure, since the portion of the supercooling tube close to the indoor part includes the bent segment that is bent toward the indoor part, the length of the supercooling tube may be further increased, and a heat exchange area of the refrigerant may be enlarged, such that the refrigerant flowing through the cooling tube may better exchange heat with the condensate water in the first water storage tank, and the temperature and pressure of the refrigerant in the supercooling tube may be further lowered, which allows the temperature to be lower when the refrigerant enters the throttle device. When the window air conditioner including the chassis assembly is cooling, an evaporation temperature of the refrigerant in the evaporator may be lower, increasing a temperature difference between the evaporation temperature and the indoor ambient temperature, and the temperature of the refrigerant when entering the throttle device may be further reduced, further improving the cooling capacity of the window air conditioner.

According to some embodiments of the present disclosure, a second water storage tank is provided at a side of the first water storage tank close to the indoor part, the second water storage tank is in communication with the first water storage tank, and the bent segment is located in the second water storage tank.

According to some embodiments of the present disclosure, the chassis assembly further includes a water receiving tray provided at the indoor part and communicating with the first water storage tank.

According to some embodiments of the present disclosure, the water receiving tray includes a drain groove opposite to the bent segment.

The window air conditioner according to embodiments of the present disclosure includes: the above chassis; and a water receiving tray provided at the indoor part and having an avoidance hole, the avoidance hole corresponding to and being in communication with the air inlet hole.

The window air conditioner according to embodiments of the present disclosure is provided with the air inlet hole in the bottom wall of the indoor part, thus part of the indoor airflow may enter the window air conditioner through the air inlet hole of the indoor part, so that the air intake area of the window air conditioner may be enlarged, satisfying the users' needs.

According to some embodiments of the present disclosure, the window air conditioner further includes a face frame. The face frame is connected to a side of the indoor part facing away from the outdoor part, and at least a part of the face frame is spaced apart from the chassis.

According to some embodiments of the present disclosure, the face frame is located at the side of the indoor part facing away from the outdoor part, an end of a bottom wall of the face frame close to the indoor part abuts against a side wall of the indoor part, and a side wall of the face frame is spaced apart from the side wall of the indoor part.

According to some embodiments of the present disclosure, the face frame includes: a body; and a bent portion located at a bottom of the body. The bent portion includes a first segment, a second segment, and a third segment. One end of the first segment is connected to a bottom end of the body and spaced apart from the side wall of the indoor part. The first segment is at an angle to the body. The second segment is located below the first segment. One end of the second segment is connected to the other end of the first segment. One end of the third segment is connected to the other end of the second segment, and the other end of the third segment abuts against the side wall of the indoor part. The first segment, the second segment, and the third segment form a groove opposite to the side wall of the indoor part. The body, the first segment, and the second segment constitute the side wall of the face frame, and the third segment constitutes the bottom wall of the face frame.

According to some embodiments of the present disclosure, a side wall of the water receiving tray facing away from the outdoor part is spaced apart from a side wall of the indoor part facing away from the outdoor part.

According to some embodiments of the present disclosure, the window air conditioner further includes a middle partition plate fixed on the chassis and configured to partition the chassis into the indoor part and the outdoor part.

According to some embodiments of the present disclosure, the middle partition plate includes: a support plate for supporting a sash; two first connection plates, respective first ends of the two first connection plates being connected to both ends of the support plate, correspondingly, and respective second ends of the two first connection plates being located in the chassis and connected to two opposite side walls of the chassis; and two second connection plates, respective first ends of the two second connection plates being connected to both ends of the support plate in a length direction. The first connection plate and the second connection plate located at the same end are spaced apart from each other, and the second connection plate is located inside the first connection plate. The first connection plate, the second connection plate, and at least a part of the support plate collectively form a mounting groove.

According to some embodiments of the present disclosure, a side wall of the chassis is provided with a locking hole, and the first connection plate is provided with a locking protrusion fitted with the locking hole.

According to some embodiments of the present disclosure, the window air conditioner is configured to be supported in a window opening of a wall body, and a movable sash is provided in the window opening. The window air conditioner further includes a housing connected to the chassis and provided with a receiving slot, at least a part of the window sash extending into the receiving slot.

According to some embodiments of the present disclosure, the window air conditioner further includes a sealing assembly configured to be in contact with the sash and an inner wall of the window opening. The sealing assembly includes: a fixing member connected to the housing; and a sealing member connected to the fixing member and sealingly provided between the sash and the inner wall of the window opening.

According to some embodiments of the present disclosure, the window air conditioner further includes a positioning device. The positioning device has an unlocking state and a locking state; in the unlocking state, the positioning device is disengaged from the window sash; and in the locking state, the positioning device is in contact with the sash to position the sash.

Additional aspects and advantages of embodiments of present disclosure will be given in part in the following descriptions, become apparent in part from the following descriptions, or be learned from the practice of the embodiments of the present disclosure.

Figure 1:
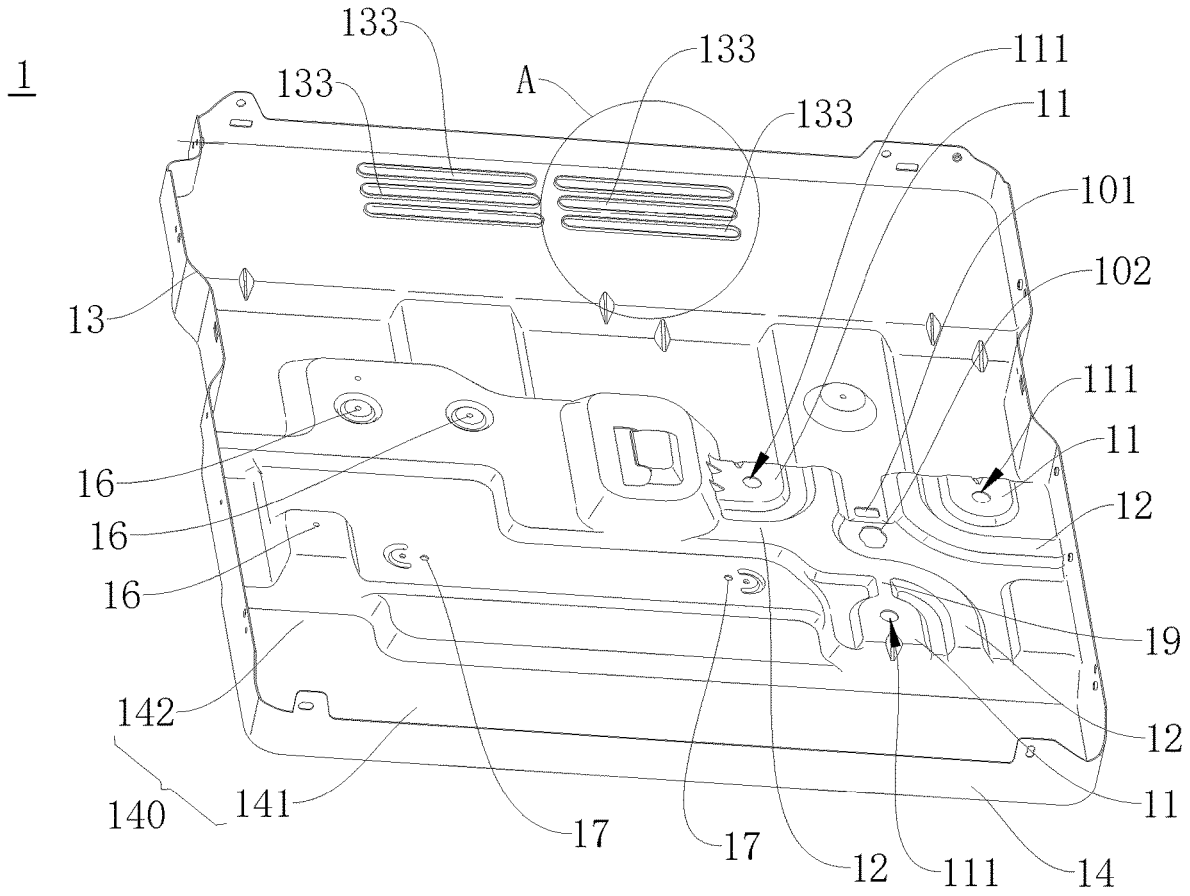
FIG. 1 is a perspective view of a chassis according to an embodiment of the present disclosure.

REFERENCE NUMERALS window air conditioner 100, chassis assembly 10, chassis 1,
drain hole 101, overflow hole 102,
mounting platform 11, connection hole 111,
reinforcement rib 12, indoor part 13, positioning hole 131, second mounting hole 132, air inlet hole 133, water blocking member 134,
outdoor part 14, water storage space 140, first water storage tank 141, second water storage tank 142,
avoidance groove 15, first fixing hole 16, second fixing hole 17, locking hole 18, connection rib 19,
sealing assembly 2, fixing member 21, sealing member 22,
housing 3, receiving slot 31, supercooling tube 4, support arm 5, compressor 6,
water receiving tray 7, first drain channel 71, drain groove 72,
positioning post 73, protrusion rib 74, avoidance hole 75,
face frame 8, body 81, bent portion 82,
first segment 821, second segment 822, third segment 823, groove 824,
middle partition plate 9, support plate 91, third mounting hole 911,
first connection plate 92, locking protrusion 921, second connection plate 93, mounting groove 94,
condenser 20, throttle device 30, back panel 40, first end 41, second end 42,
bent segment 43, tube clamp 50, tube groove 51, indoor portion 61, outdoor portion 62,
wall body 200, window opening 210,
sash 300, positioning device 400.

DETAILED DESCRIPTION

Reference will be made in detail to embodiments of the present disclosure, and the examples of the embodiments are illustrated in the drawings, wherein the same or similar elements and the elements having same or similar functions are denoted by like reference numerals throughout the descriptions. The embodiments described herein with reference to drawings are illustrative, and merely used to explain the present disclosure. The embodiments shall not be construed to limit the present disclosure.

The following disclosure provides many different embodiments or examples for implementing different structures of this application. In order to simplify the disclosure of this application, components and settings of specific examples will be described below. Certainly, they are merely examples and are not intended to limit this application. In addition, reference numerals and/or letters may be repeated in different examples in this application. This repetition is for the purpose of simplification and clarity and does not refer to relations between different embodiments and/or settings. Furthermore, examples of different processes and materials are provided in this application. However, it would be appreciated by those skilled in the art that other processes and/or materials may be also applied.

A chassis 1 for a window air conditioner 100 according to embodiments of the present disclosure will be described below with reference to the drawings.

Figure 2:
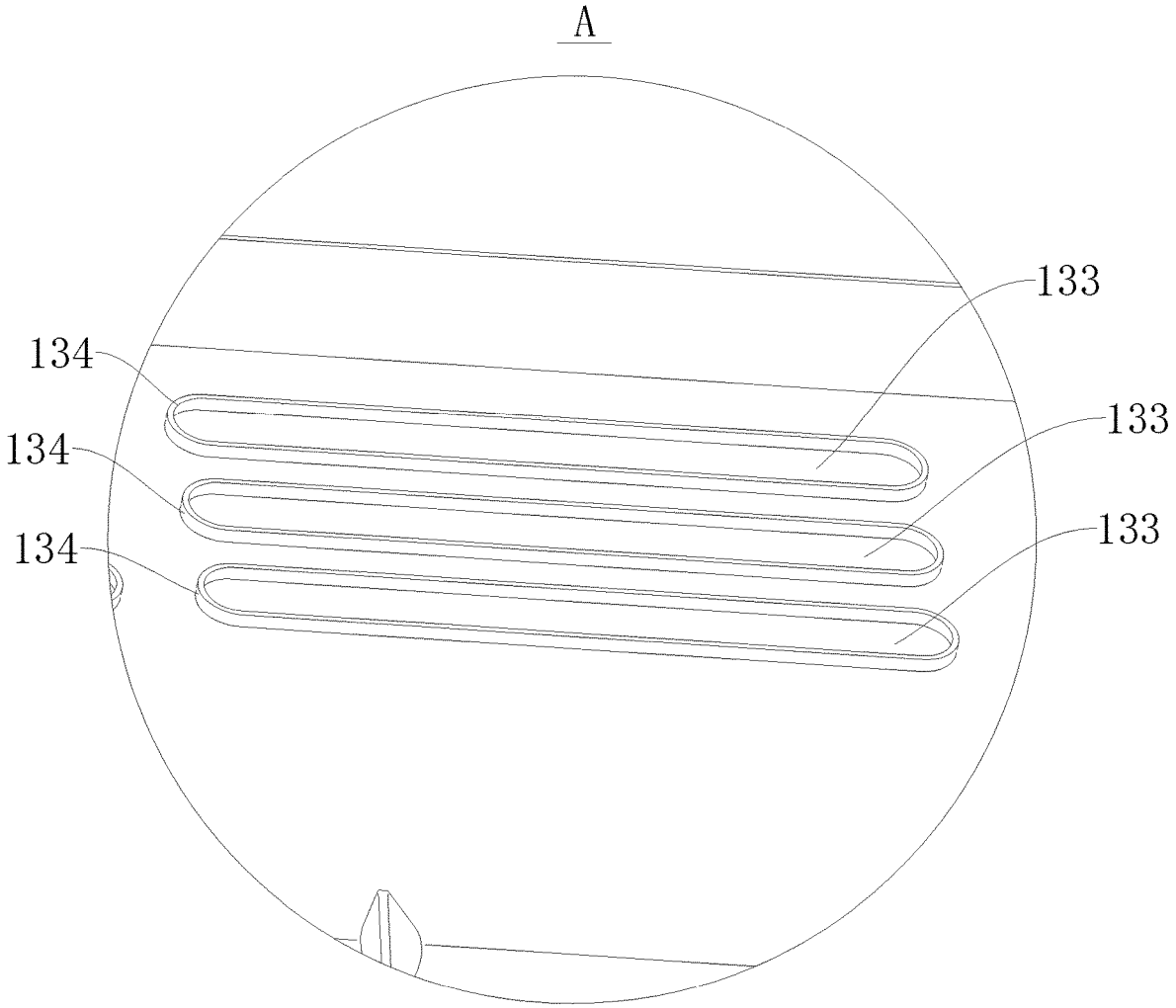
FIG. 2 is an enlarged view of part A in FIG. 1.

As shown in FIGS. 1 and 2, the chassis 1 for the window air conditioner 100 according to the embodiments of the present disclosure includes an indoor part 13 and an outdoor part 14 arranged along a length direction of the chassis 1. A bottom wall of the indoor part 13 includes an air inlet hole 133, and the air inlet hole 133 penetrates the chassis 1 in a thickness direction of the indoor part 13.

It could be understood that, with the air inlet hole 133 being provided in the bottom wall of the indoor part 13, part of an indoor airflow may enter the window air conditioner 100 through the air inlet hole 133 of the indoor part 13, and an air intake area of the window air conditioner 100 is increased, thereby satisfying users' needs.

In addition, the increase in the air intake area of the window air conditioner 100 may also reduce the speed of the airflow flowing into the window air conditioner 100, so that the noise when the airflow flows into the window air conditioner 100 is reduced, thereby improving the users' comfort.

For example, in an example of the present disclosure, the chassis 1 includes the indoor part 13 located indoors and the outdoor part 14 located outdoors, and the bottom wall of the indoor part 13 is provided with the air inlet hole 133, such that part of the indoor airflow may enter the window air conditioner 100 through the air inlet hole 133.

In some embodiments of the present disclosure, as shown in FIG. 2, the air inlet hole 133 is formed as a long strip-shaped hole. The long strip-shaped hole has the advantages of simple structure and easy formation, and the resistance when the airflow flows through the long strip-shaped hole is relatively small, which may improve the smoothness of the airflow and reduce the energy consumption of the window air conditioner 100.

As for the chassis 1 for the window air conditioner 100 according to the embodiments of the present disclosure, with the air inlet hole 133 being provided in the bottom wall of the indoor part 13, part of the indoor airflow may enter the window air conditioner 100 through the air inlet hole 133 of the indoor part 13, so that the air intake area of the window air conditioner 100 may be enlarged, the air intake volume of the window air conditioner 100 may be increased, and thus the heat exchange efficiency of the window air conditioner 100 may be improved.

According to some embodiments of the present disclosure, as shown in FIGS. 1 and 2, an upper surface of the bottom wall of the indoor part 13 is further provided with an annular water blocking member 134, and the water blocking member 134 is disposed around the air inlet hole 133. It could be understood that part of condensate water generated by an indoor heat exchanger of the window air conditioner 100 will drip onto the bottom wall of the indoor part 13, and with the water blocking member 134 being provided around the air inlet hole 133, this part of the condensate water may be prevented from dripping into an indoor space from the air inlet hole 133, thereby ensuring the operational safety and reliability of the window air conditioner 100. For example, in an example of the present disclosure, an inner wall surface of the water blocking member 134 is flush with an inner wall surface of the air inlet hole 133.

In some embodiments of the present disclosure, as shown in FIG. 2, the water blocking member 134 is formed as a flange. Thus, the structure of the water blocking member 134 may be simplified, the manufacturing difficulty of the water blocking member 134 may be reduced, the production efficiency of the water blocking member 134 may be improved, and the production cost of the water blocking member 134 may be lowered. Specifically, in an example of the present disclosure, the flange and the chassis 1 are formed as an integral piece.

In some embodiments of the present disclosure, as shown in FIGS. 1 and 2, a plurality of air inlet holes 133 are provided and arranged in multiple rows and columns, and a plurality of water blocking members 134 are provided and arranged in one-to-one correspondence with the plurality of air inlet holes 133. As a result, the air intake area of the window air conditioner 100 may be further increased, thereby further reducing the speed of the airflow flowing into the window air conditioner 100 and reducing the noise when the airflow flows into the window air conditioner 100, so as to further enhance the users' comfort.

Figure 3:
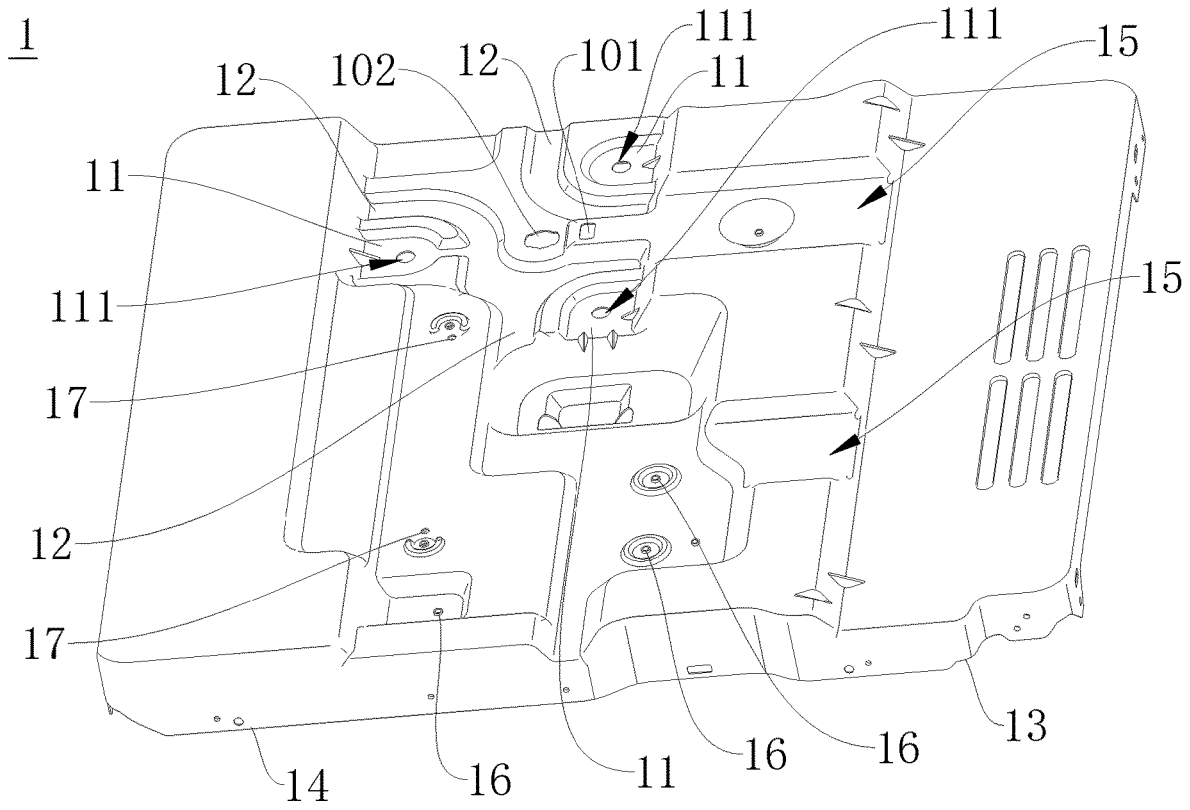
FIG. 3 is a perspective view of a chassis according to an embodiment of the present disclosure from another angle of view.

According to some embodiments of the present disclosure, as shown in FIGS. 1 and 3, the outdoor part 14 includes a drain hole 101 and an overflow hole 102 spaced apart from each other. The overflow hole 102 and the drain hole 101 both penetrate the chassis 1. It could be understood that in rainy days, some rainwater may fall into the chassis 1 of the window air conditioner 100, and the drain hole 101 cannot meet a need to discharge rainwater and condensate water rapidly. In such a case, the overflow hole 102 may function as drainage together with the drain hole 101, to effectively avoid further water accumulation in the chassis 1, and ensure the operational safety and reliability of the window air conditioner 100.

In some embodiments of the present disclosure, as shown in FIGS. 1 and 3, the overflow hole 102 and the drain hole 101 are arranged along the length direction of the chassis 1, and the drain hole 101 is located at a side of the overflow hole 102 away from the indoor part 13. It could be understood that compared with a portion of the chassis 1 close to the indoor part 13, rain is more likely to hit a portion of the chassis 1 away from the indoor part 13, and with the overflow hole 102 being provided at a side of the drain hole 101 away from the indoor part 13, rainwater may be discharged from the overflow hole 102 more easily, and the drainage of accumulated water may be accelerated.

Figure 4:
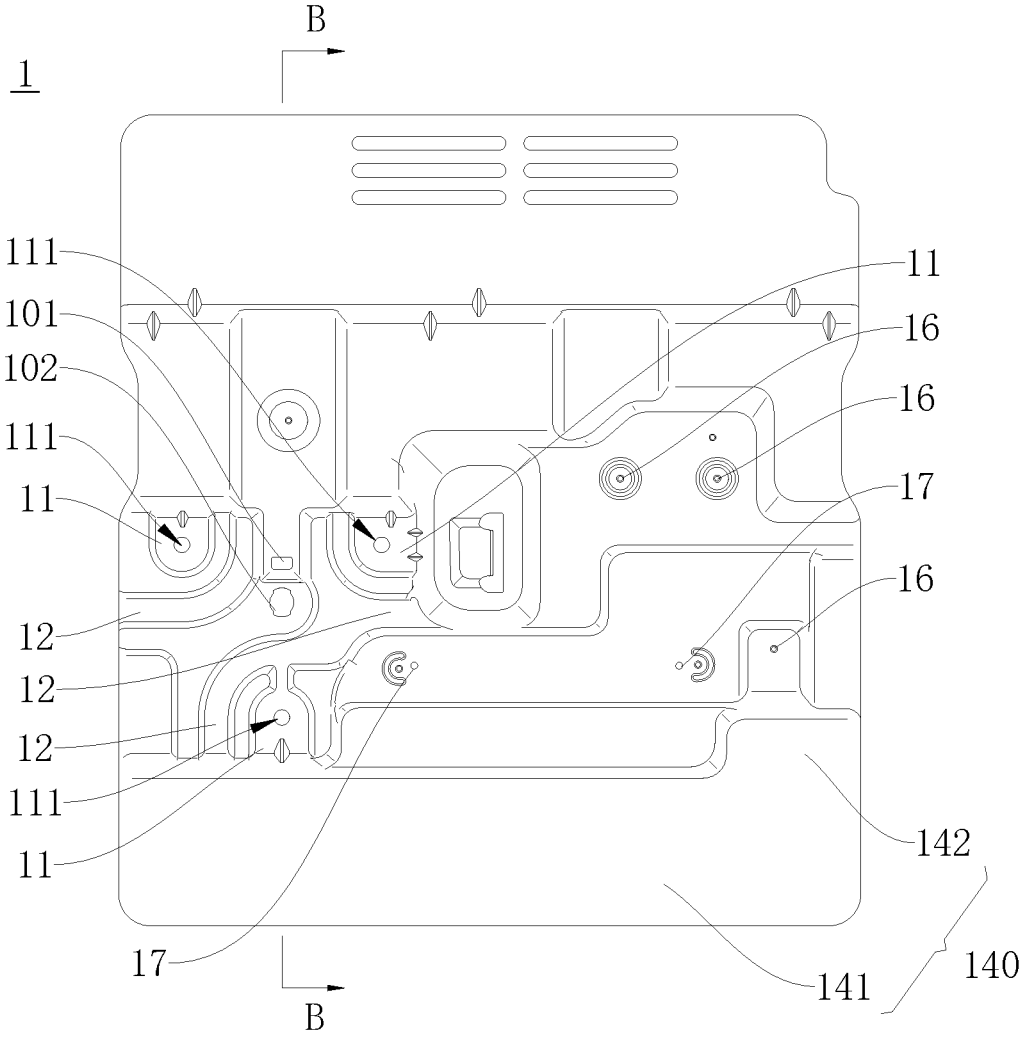
FIG. 4 is a front view of a chassis according to an embodiment of the present disclosure.
Figure 5:
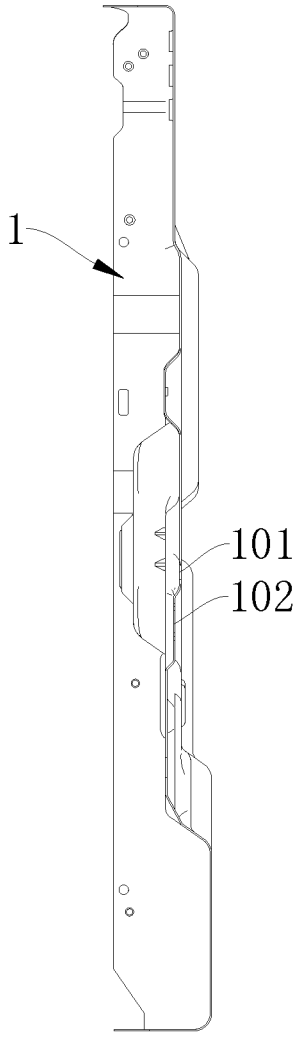
FIG. 5 is a sectional view taken along line B-B in FIG. 4.

In some embodiments of the present disclosure, as shown in FIGS. 4 and 5, a cross-sectional area of the overflow hole 102 is greater than or equal to a cross-sectional area of the drain hole 101. It could be understood that when the overflow hole 102 is in use, there is much water accumulation on the chassis 1, and by configuring the cross-sectional area of the overflow hole 102 to be greater than or equal to the cross-sectional area of the drain hole 101, the water accumulated on the chassis 1 may be quickly discharged, thereby further improving the operational safety and reliability of the window air conditioner 100.

For example, in an example of the present disclosure, the cross-sectional area of the overflow hole 102 is larger than the cross-sectional area of the drain hole 101. In another example of the present disclosure, the cross-sectional area of the overflow hole 102 is equal to the cross-sectional area of the drain hole 101.

In some embodiments of the present disclosure, as shown in FIGS. 1 and 3, a water inlet end surface of the overflow hole 102 is higher than a water inlet end surface of the drain hole 101. It could be understood that when a liquid level in the chassis 1 exceeds the water inlet end surface of the drain hole 101 and is lower than the water inlet end surface of the overflow hole 102, the water accumulated in the chassis 1 is less and may be discharged through the drain hole 101 in time. When the liquid level in the chassis 1 exceeds the water inlet end surface of the overflow hole 102, rainwater and condensate water in the chassis 1 may be discharged through the overflow hole 102 and the drain hole 101 together, so that the rapid discharge of rainwater and condensate water may be achieved, thereby avoiding excess water accumulation in the chassis 1, which may further ensure the operational reliability of the window air conditioner 100. In addition, by setting the water inlet end surface of the overflow hole 102 to be higher, it may be more difficult for mice to climb into the chassis 1 from the overflow hole 102, thereby improving the operational safety of the window air conditioner 100.

In some embodiments of the present disclosure, the overflow hole 102 is formed as a circular hole, an oval hole, or a polygonal hole. It could be understood that the drainage efficiency of the overflow hole 102 is related to the shape of the overflow hole 102 and the working environment. In order to ensure the high drainage efficiency of the overflow hole 102, the shape of the overflow hole 102 may be appropriately selected according to specific application environments. Specifically, the shape of the overflow hole 102 may be appropriately selected according to the model, size, and application environment of the chassis 1, so as to improve the drainage efficiency of the overflow hole 102.

In some embodiments of the present disclosure, as shown in FIGS. 1 and 4, the chassis 1 further includes a first fixing hole 16 for fixing an electric control box, and the first fixing hole 16 is spaced apart from the drain hole 101 and the overflow hole 102 in a width direction of the chassis 1. It could be understood that the electric control box may be fixed on the chassis 1 through the first fixing hole 16. Compared with a technical solution in the related art that the electric control box is provided at a side wall of the window air conditioner, the mounting difficulty of the electric control box in the present disclosure is reduced and the mounting strength is higher. For example, in an example of the present disclosure, the chassis 1 includes three first fixing holes 16 for fixing the electric control box, and the three first fixing holes 16 are spaced apart from one another.

In some embodiments of the present disclosure, as shown in FIGS. 1 and 4, the chassis 1 further includes a second fixing hole 17 for fixing a back panel. In the width direction of the chassis 1, the second fixing hole 17 is located between the overflow hole 102 and the first fixing hole 16. It could be understood that the back panel may be fixed on the chassis 1, and with the second fixing hole 17, the difficulty of fixing the back panel may be reduced and the efficiency of fixing the back panel may be improved. In addition, since the second fixing hole 17 is provided between the overflow hole 102 and the first fixing hole 16, the back panel may be spaced apart from the overflow hole 102 and the electric control box, thereby avoiding interference between the back panel and the electric control box, and contact between the water accumulated in the chassis 1 and the back panel may also be avoided.

For example, in an example of the present disclosure, there are two second fixing holes 17, and the two second fixing holes 17 are both located between the overflow hole 102 and the first fixing hole 16 and are spaced in the width direction of the chassis 1.

According to some embodiments of the present disclosure, as shown in FIG. 3, a lower surface of the chassis 1 includes an avoidance groove 15 recessed upward, and the avoidance groove 15 extends along the length direction of the chassis 1. It could be understood that the bottom of the chassis 1 may be provided with a support arm 5 for support. With the avoidance groove 15 being provided in the lower surface of the chassis 1, the support arm 5 may be disposed in the avoidance groove 15 to prevent interference between the support arm 5 and the chassis 1 from occurring and diminishing the structural strength of the chassis 1, so as to ensure the structural reliability of the chassis 1. In addition, since the avoidance groove 15 is formed by the lower surface of the chassis 1 being partially recessed upward, the processing complexity and processing cost of the avoidance groove 15 may be reduced.

In some embodiments of the present disclosure, as shown in FIG. 3, a plurality of avoidance grooves 15 are provided and spaced apart in the width direction of the chassis 1. Therefore, users may select one, two or more of the avoidance grooves 15 to mount the support arm 5 as needed, or may mount the support arm 5 in the avoidance groove 15 at a suitable position as needed. The plurality of avoidance grooves 15 may offer a variety of options, which may better meet the users' mounting needs. For example, in an example of the present disclosure, there are two avoidance grooves 15, and the two avoidance grooves 15 are spaced apart in the width direction of the chassis 1.

According to some embodiments of the present disclosure, the chassis 1 is an integrally formed piece. Thus, the structure of the integral piece may not only ensure the structure and performance stability of the chassis 1, but also facilitate the formation and manufacturing. Moreover, redundant assembly parts and connection processes are omitted, greatly improving the assembly efficiency of the chassis 1 and ensuring the connection reliability of the chassis 1. Furthermore, the overall strength and stability of the integrally formed structure is higher, the assembly is more convenient, and the service life is longer. For example, in one example of the present disclosure, the chassis 1 is integrally formed by stamping.

Figure 7:
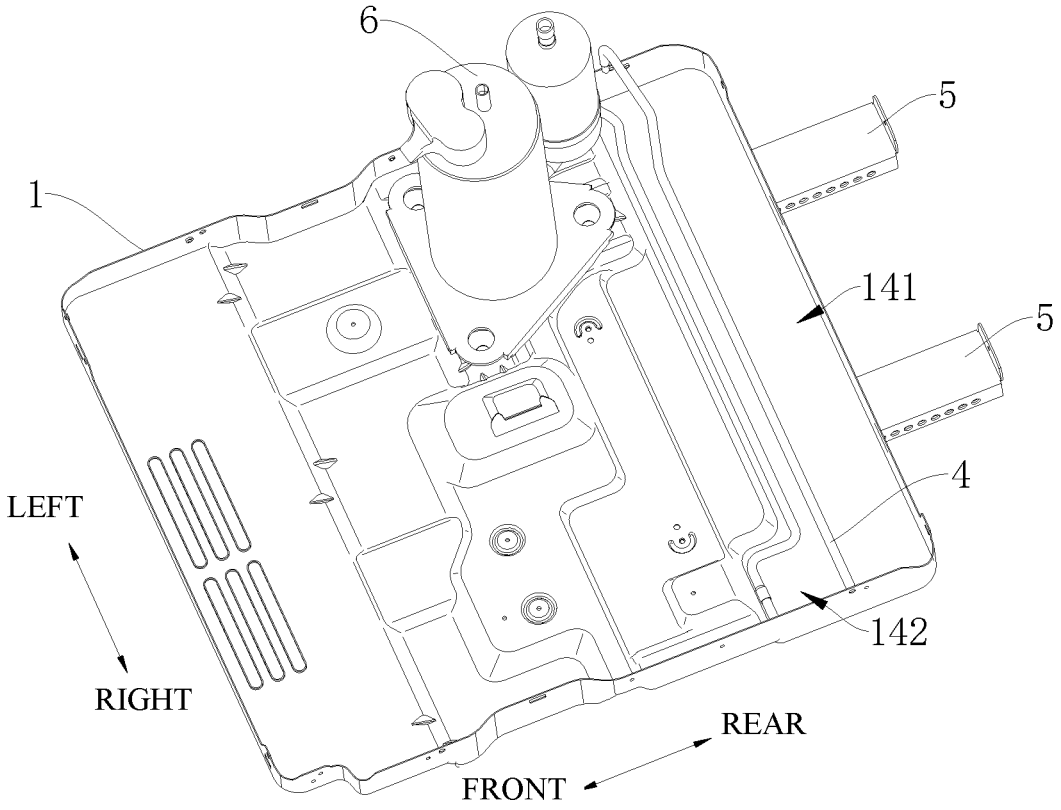
FIG. 7 is a schematic structural diagram of a chassis, a compressor, and a support arm according to an embodiment of the present disclosure.

According to some embodiments of the present disclosure, as shown in FIGS. 1 and 7, an upper surface of a bottom wall of the outdoor part 14 includes a mounting platform 11 for mounting a compressor 6. A portion of the chassis 1 protrudes upward to form a reinforcement rib 12, and the reinforcement rib 12 extends in a peripheral direction of the mounting platform 11 and is spaced apart from the mounting platform 11.

It could be understood that, compared with a structure of a flat chassis 1, the reinforcement rib 12 protruding upward has higher structural strength. Since the reinforcement rib 12 is disposed adjacent to the mounting platform 11 and extends in the peripheral direction of the mounting platform 11, the structural strength of the chassis 1 adjacent to the mounting platform 11 may be enhanced.

In the related art, the chassis is formed as a flat plate. When the compressor is mounted on the chassis, under the effect of the weight of the compressor, a corresponding area of the chassis used to mount the compressor exhibits a problem of being recessed downward and deformed, which diminishes the structural strength and service life of the whole chassis.

In the present disclosure, the reinforcement rib 12 may enhance the structural strength of the chassis 1 adjacent to the mounting platform 11. When the compressor 6 is mounted on the mounting platform 11, the need for the structural strength of the chassis 1 during mounting and operation of the compressor 6 may be better satisfied, so that the problem of deformation of the chassis 1 may be avoided, and the service life of the chassis 1 may be extended.

In some embodiments of the present disclosure, as shown in FIGS. 1 and 3, there are a plurality of mounting platforms 11 and a plurality of reinforcement ribs 12, and the plurality of reinforcement ribs 12 are in one-to-one correspondence with the plurality of mounting platforms 11. It could be understood that the compressor 6 may be carried on the plurality of mounting platforms 11, and the plurality of mounting platforms 11 may be used to jointly bear the weight of the compressor 6. With a corresponding reinforcement rib 12 being provided at each mounting platform 11, the structural strength of the chassis 1 adjacent to each mounting platform 11 may be enhanced, thereby further ensuring the good structural strength of the chassis 1 during the mounting and operation of the compressor 6.

For example, in an example of the present disclosure, the compressor 6 includes three mounting brackets, the chassis 1 is provided with three corresponding mounting platforms 11, and each mounting platform 11 includes a corresponding reinforcement rib 12.

In some embodiments of the present disclosure, as shown in FIGS. 3 and 4, the mounting platform 11 includes a connection hole 111 for fixing the compressor 6, and the connection hole 111 penetrates the mounting platform 11. As a result, the connection structure between the chassis 1 and the compressor 6 may be simplified, and the difficulty of connecting the compressor 6 and the mounting platform 11 may be reduced. In addition, while the connection strength between the compressor 6 and the mounting platform 11 is ensured, the cost may also be reduced.

In some embodiments of the present disclosure, as shown in FIGS. 1 and 4, the reinforcement rib 12 is formed as a curved rib. It could be understood that curved ribs may bear greater stress than straight ribs. As a result, the structural strength of the chassis 1 adjacent to the mounting platform 11 may be further improved, which further satisfies the need for the structural strength of the chassis 1 during mounting and operation of the compressor 6 and better avoids the deformation of the chassis 1, thereby further prolonging the service life of the chassis 1.

In some embodiments of the present disclosure, as shown in FIGS. 1 and 4, in the peripheral direction of the mounting platform 11, the reinforcement rib 12 surrounds a portion of the mounting platform 11. Thus, while the structural strength of the chassis 1 adjacent to the mounting platform 11 is ensured, an area for processing and manufacturing the rib 12 may be decreased, thereby reducing a space of the chassis 1 occupied by the rib 12, and the processing cost of the rib 12 may also be lowered. For example, in one example of the present disclosure, the mounting platform 11 is half surrounded by the reinforcement rib 12. Specifically, portions, facing each other, of two adjacent mounting bases 11 are surrounded by corresponding reinforcement ribs 12.

In some embodiments of the present disclosure, as shown in FIGS. 1 and 7, a portion of the chassis 1 protrudes upward to form a connection rib 19. One end of the connection rib 19 is connected to the mounting platform 11, and the other end of the connection rib 19 is connected to the reinforcement rib 12. As a result, the structural strength of the chassis 1 adjacent to the mounting platform 11 may be further improved, which further satisfies the need for the structural strength of the chassis 1 during mounting and operation of the compressor 6 and better avoids the deformation of the chassis 1, thereby further prolonging the service life of the chassis 1.

In some embodiments of the present disclosure, as shown in FIGS. 1 and 4, the outdoor part 14 includes a first water storage tank 141 spaced apart from the mounting platform 11. The first water storage tank 141 may be used to receive condensate water. The mounting platform 11 is spaced from the first water storage tank 141, which may separate the compressor 6 from the first water storage tank 141, so as to effectively prevent the condensate water in the first water storage tank 141 from contacting the compressor 6, thereby improving the reliability of mounting and operation of the compressor 6.

It should be noted that the window air conditioner 100 may include a supercooling tube 4, the first water storage tank 141 may be used to store the condensate water, and a high-temperature and high-pressure refrigerant discharged from an outlet of a condenser may exchange heat with the condensate water in the water storage tank 141 through the supercooling tube 4 and then enters a capillary tube. Thus, the working efficiency of the window air conditioner 100 may be improved.

Figure 8:
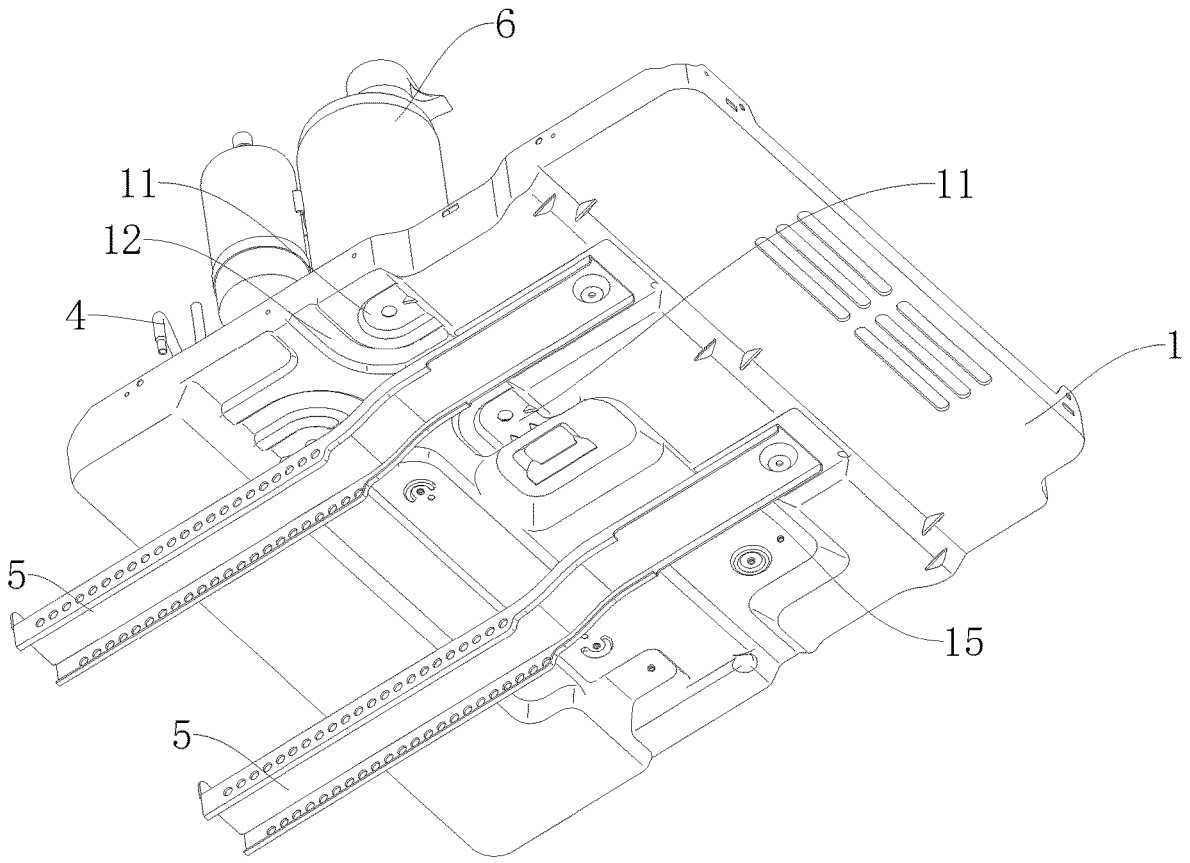
FIG. 8 is a schematic structural diagram of a chassis, a compressor, and a support arm according to an embodiment of the present disclosure from another angle of view.

In some embodiments of the present disclosure, as shown in FIGS. 7 and 8, the first water storage tank 141 extends in the width direction of the chassis 1 and extends from one end of the chassis 1 in the width direction to the other end of the chassis 1 in the width direction (a left-right direction shown in FIG. 4). Thus, the length of the first water storage tank 141 may be increased, so that the first water storage tank 141 may store more condensate water, and sufficient heat exchange with the high-temperature and high-pressure refrigerant may be performed, thereby further enhancing the working efficiency of the window air conditioner 100.

In addition, the length of the supercooling tube 4 cooperating with the first water storage tank 141 may also be correspondingly increased, so that a heat exchange area of the supercooling tube 4 with the condensate water is further enlarged, and the amount of heat exchange between the refrigerant and the condensate water may be further improved, thereby further enhancing the working efficiency of the window air conditioner 100.

In some embodiments of the present disclosure, as shown in FIGS. 1 and 7, the outdoor part 14 further includes a second water storage tank 142. The second water storage tank 142 is provided at a side of the first water storage tank 141 close to the indoor part 13. The second water storage tank 142 is in communication with the first water storage tank 141. It could be understood that the condensate water may enter the first water storage tank 141 through the second water storage tank 142, and the condensate water may be stored in the first water storage tank 141 and the second water storage tank 142. Thus, on the one hand, the storage space for the condensate water may be further expanded, thereby further increasing the amount of heat exchange between the refrigerant and the condensate water; on the other hand, a part of the supercooling tube 4 may be disposed in the second water storage tank 142, and a distance between the condensate water and the supercooling tube 4 is reduced, so as to reduce the moving distance of the condensate water and realize the rapid encounter and heat exchange between the condensate water and the refrigerant.

In some embodiments of the present disclosure, as shown in FIGS. 4 and 7, in the width direction of the chassis 1 (the left-right direction shown in FIG. 7), the second water storage tank 142 is located at one end of the first water storage tank 141. The condensate water is suitable to flow into the first water storage tank 141 from one end of the first water storage tank 141 and then move toward the other end of the first water storage tank 141. Since the second water storage tank 142 is disposed at one end of the first water storage tank 141, the condensate water may flow into the first water storage tank 141 through the second water storage tank 142. It should be noted that the inflow direction of the condensate water may be selected according to the position of the second water storage tank 142.

For example, when the second water storage tank 142 is located at a left end of the first water storage tank 141 in a length direction, the condensate water flows in from the second water storage tank 142 at the left end of the first water storage tank 141 in the length direction; when the second water storage tank 142 is located at a right end of the first water storage tank 141 in the length direction, the condensate water flows in from the second water storage tank 142 at the right end of the first water storage tank 141 in the length direction.

The window air conditioner 100 according to some embodiments of the present disclosure will be described below with reference to the drawings.

Figure 6:
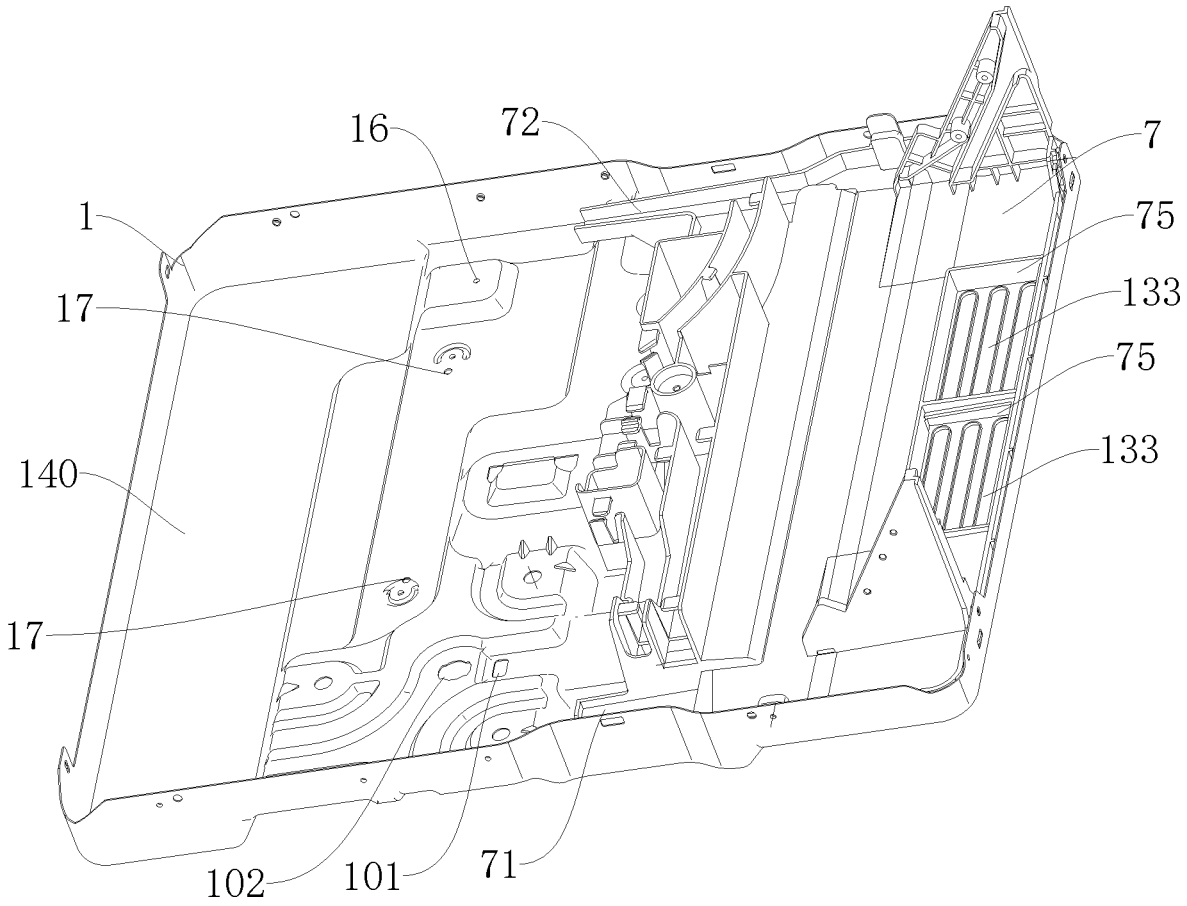
FIG. 6 is a schematic structural diagram of a chassis and a water receiving tray according to an embodiment of the present disclosure.

As shown in FIGS. 1 and 6, the window air conditioner 100 according to embodiments of the present disclosure includes: the above-mentioned chassis 1 and a water receiving tray 7. The water receiving tray 7 is provided on the indoor part 13. The water receiving tray 7 includes an avoidance hole 75, and the avoidance hole 75 is corresponding to and in communication with the air inlet hole 133. It could be understood that, with the avoidance hole 75 being provided in the water receiving tray 7, the airflow entering the window air conditioner 100 from the air inlet hole 133 of the indoor part 13 may pass through the avoidance hole 75 to exchange heat with the indoor heat exchanger in the window air conditioner 100, which may improve the smoothness of the airflow toward the indoor heat exchanger.

For the window air conditioner 100 according to embodiments of the present disclosure, with the air inlet hole 133 being provided in the bottom wall of the indoor part 13, part of the indoor airflow may enter the window air conditioner 100 through the air inlet hole 133 of the indoor part 13, so that the air intake area of the window air conditioner 100 may be enlarged, satisfying the users' needs.

Figure 9:
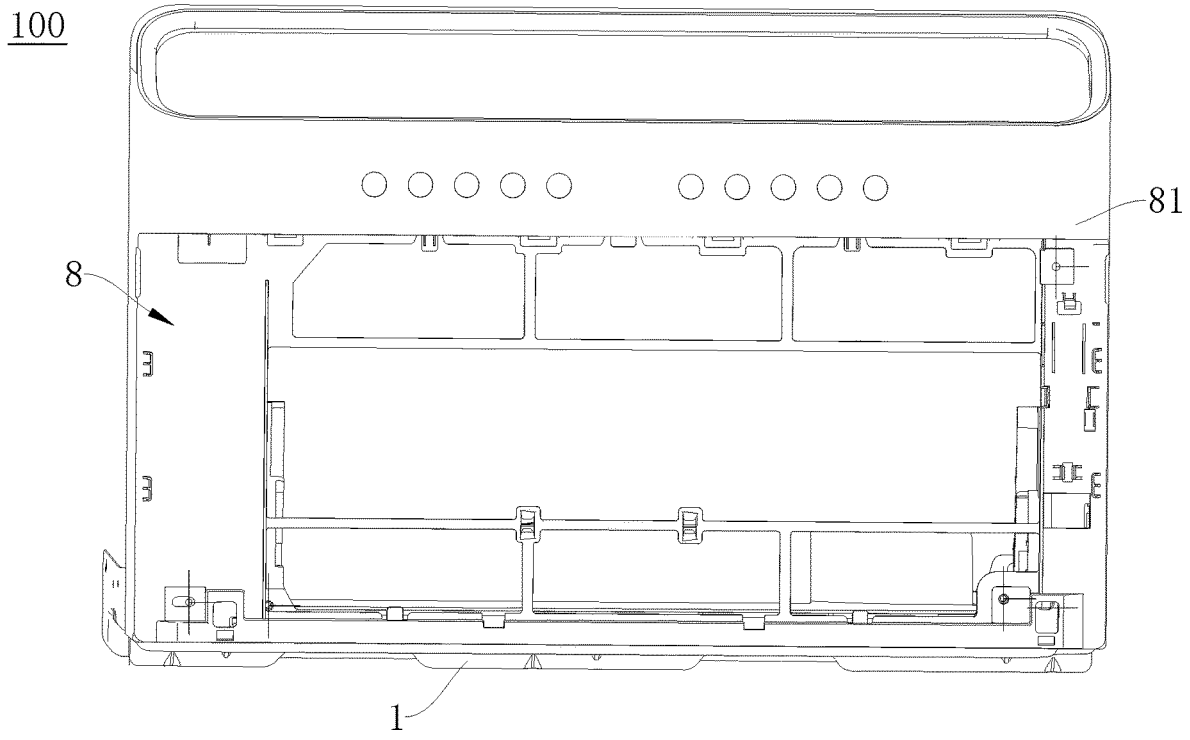
FIG. 9 is a partial structural diagram of a window air conditioner according to an embodiment of the present disclosure.
Figure 10:
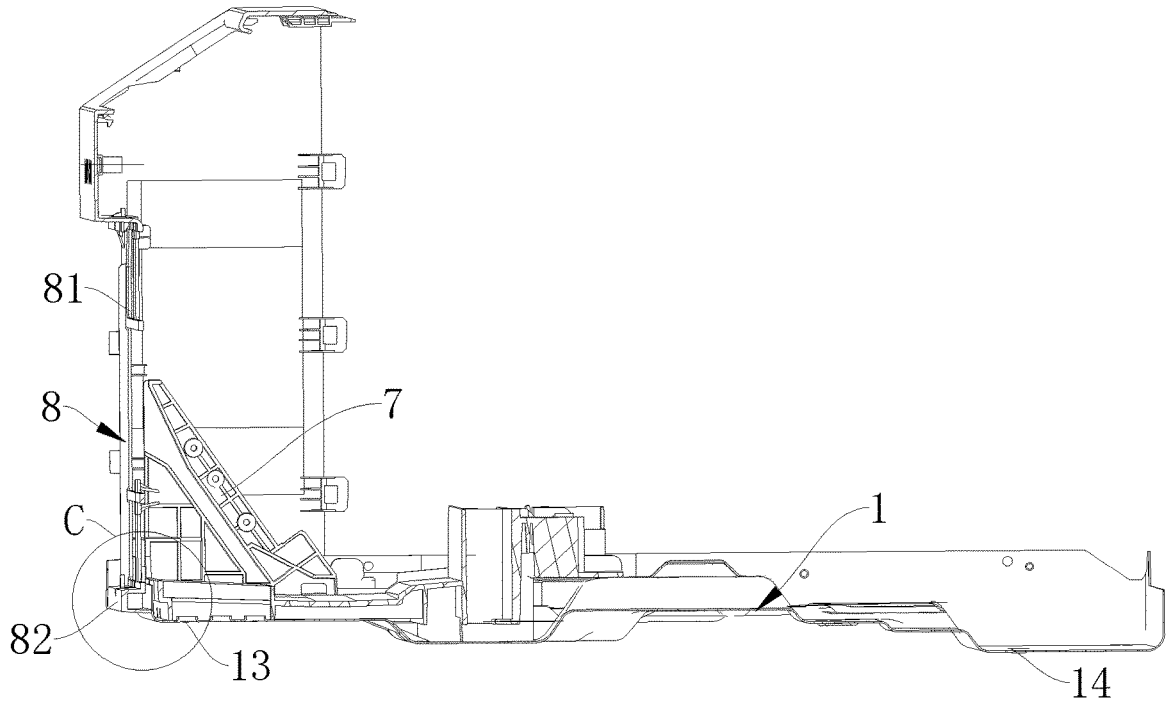
FIG. 10 is a sectional view of a face frame and a chassis of a window air conditioner according to an embodiment of the present disclosure.
Figure 11:
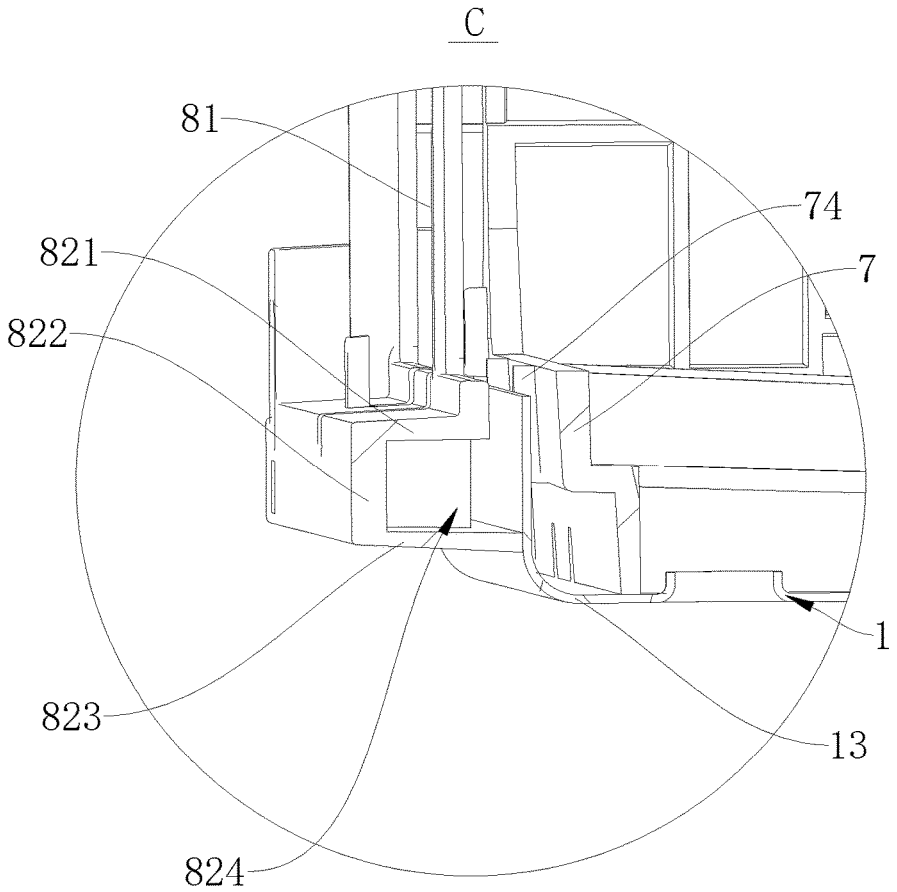
FIG. 11 is an enlarged view of part C in FIG. 10.

According to some embodiments of the present disclosure, as shown in FIG. 9, the window air conditioner 100 further includes a face frame 8. As shown in FIGS. 10 and 11, the face frame 8 is connected to a side of the indoor part 13 facing away from the outdoor part 14, and at least a part of the face frame 8 is spaced apart from the chassis 1.

In some embodiments of the present disclosure, as shown in FIGS. 10 and 11, the face frame 8 is located at the side of the indoor part 13 that faces away from the outdoor part 14, an end of a bottom wall of the face frame 8 close to the indoor part 13 abuts against a side wall of the indoor part 13, and a side wall of the face frame 8 is spaced apart from the side wall of the indoor part 13. It could be understood that the face frame 8 may be partially spaced apart from the chassis 1; or the face frame 8 may be entirely spaced apart from the chassis 1. There is a large temperature difference between the face frame 8 and the chassis 1. In the present disclosure, by spacing at least a part of the face frame 8 from the chassis 1, a contact area between the face frame 8 and the chassis 1 is decreased, which may reduce or avoid the condensate water generated between the face frame 8 and the chassis 1, and thus improve the operational safety of the window air conditioner 100.

For example, in an example of the present disclosure, the chassis 1 includes the indoor part 13 located indoors and the outdoor part 14 located outdoors; the face frame 8 is connected to the indoor part 13 and located at the side of the indoor part 13 away from the outdoor; and the face frame 8 is spaced apart from the chassis 1. Thus, the face frame 8 and the chassis 1 are no longer in contact, and the condensate water generated due to the contact may be avoided, thereby improving the operational safety and reliability of the window air conditioner 100.

It should be noted that a cross-sectional area of the bottom wall of the face frame 8 is relatively small, and when the end of the bottom wall of the face frame 8 close to the indoor part 13 abuts against the side wall of the indoor part 13, a contact area between the surface frame 8 and the indoor part 13 is relatively limited, and it is difficult to produce the condensate water in the contact area. Thus, while the connection reliability of the face frame 8 is ensured, the generation of the condensate water may also be effectively avoided.

In some embodiments of the present disclosure, as shown in FIGS. 10 and 11, the face frame 8 includes a body 81 and a bent portion 82, and the bent portion 82 is located at the bottom of the body 81. For example, in an example of the present disclosure, the face frame 8 is connected to the chassis 1 through the bent portion 82 at the bottom, and the body 81 is not in contact with the chassis 1. The bent portion 82 includes a first segment 821, a second segment 822, and a third segment 823. One end of the first segment 821 is connected to a bottom end of the body 81 and is spaced apart from the side wall of the indoor part 13, and the first segment 821 is at an angle to the body 81. The second segment 822 is located below the first segment 821, and one end of the second segment 822 is connected to the other end of the first segment 821. One end of the third segment 823 is connected to the other end of the second segment 822, while the other end of the third segment 823 abuts against the side wall of the indoor part 13. The first segment 821, the second segment 822, and the third segment 823 form a groove 824 opposite to the side wall of the indoor part 13, wherein the body 81, the first segment 821, and the second segment 822 constitute the side wall of the face frame 8, and the third segment 823 constitutes the bottom wall of the face frame 8. The structure of the bent portion 82 is relatively simple, the manufacturing difficulty and manufacturing cost of the bent portion 82 are relatively low, and thus the production and processing cycle of the bent portion 82 may be shortened.

According to some embodiments of the present disclosure, a side wall of the water receiving tray 7 facing away from the outdoor part 14 is spaced apart from a side wall of the indoor part 13 facing away from the outdoor part 14. It could be understood that the side wall of the water receiving tray 7 facing away from the outdoor part 14 is no longer in contact with the side wall of the indoor part 13 facing away from the outdoor part 14. Thus, it is possible to avoid generating the condensate water due to the contact between the side wall of the water receiving tray 7 facing away from the outdoor part 14 and the side wall of the indoor part 13 facing away from the outdoor part 14, so as to improve the operational safety and reliability of the window air conditioner 100.

Figure 14:
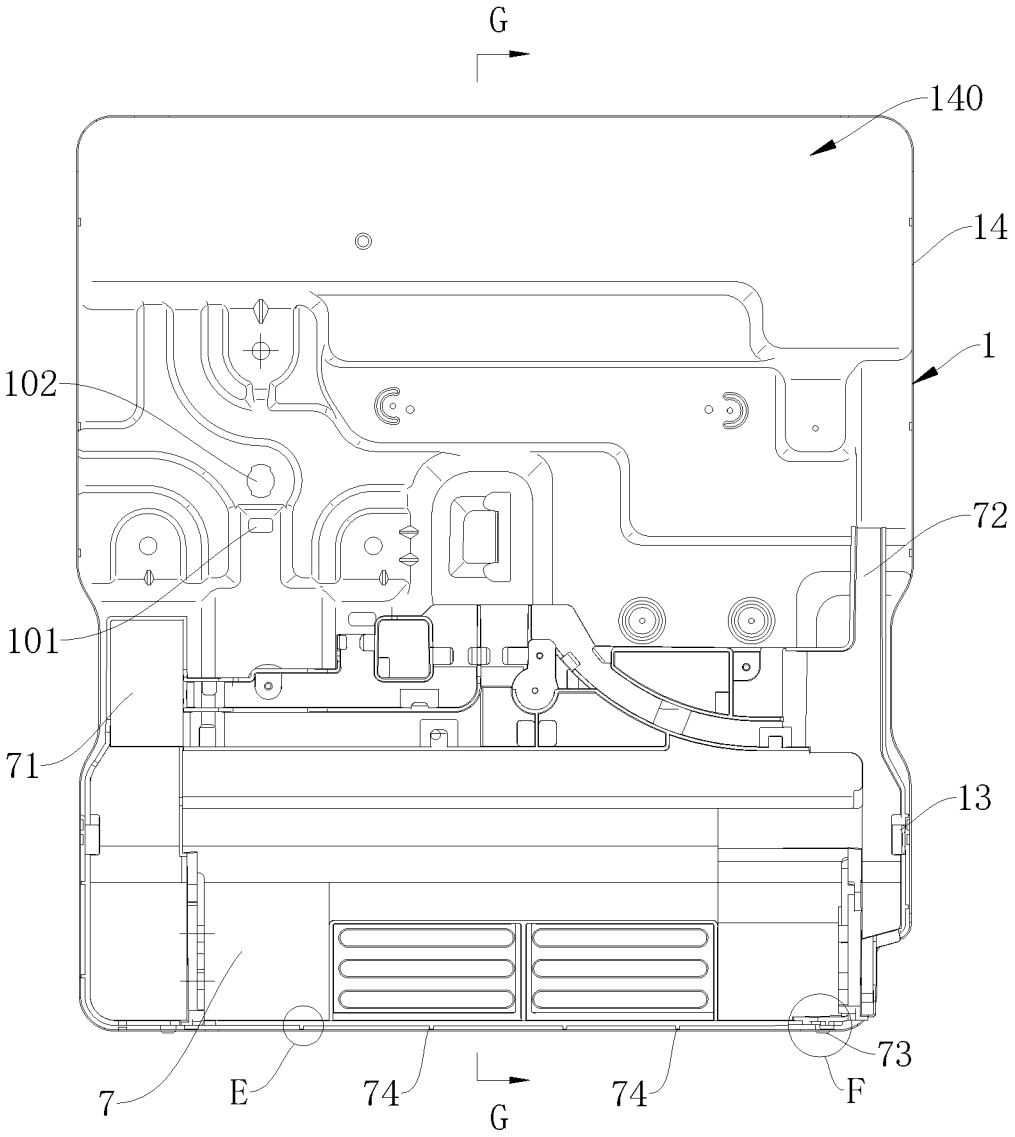
FIG. 14 is a top view of a chassis and a water receiving tray of a window air conditioner according to an embodiment of the present disclosure.
Figure 15:
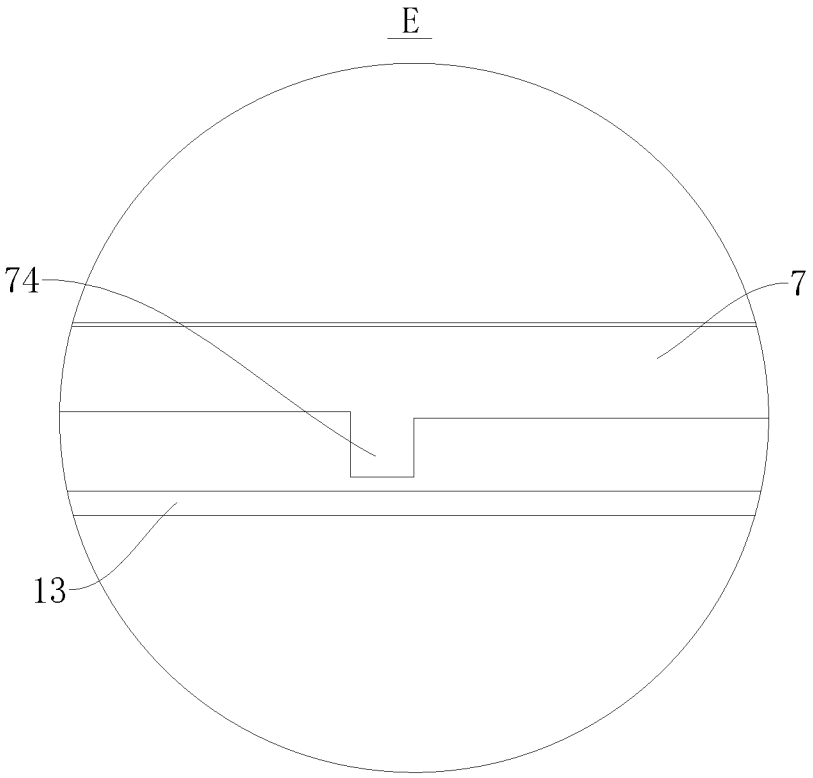
FIG. 15 is an enlarged view of part E in FIG. 14.

In some embodiments of the present disclosure, as shown in FIGS. 14 and 15, the window air conditioner 100 (in conjunction with FIG. 9) further includes a protrusion rib 74, and the protrusion rib 74 is located between the side wall of the water receiving tray 7 facing away from the outdoor part 14 and the side wall of the indoor part 13 facing away from the outdoor part 14. It could be understood that the protrusion rib 74 may not only separate the side wall of the water receiving tray 7 facing away from the outdoor part 14 from the side wall of the indoor part 13 facing away from the outdoor part 14, but also function to limit the position of the water receiving tray 7 to avoid accidental contact during the mounting and operation of the water receiving tray 7, thereby ensuring the reliability of the mounting and operation of the water receiving tray 7. In addition, the structure of the protrusion rib 74 is relatively simple, the manufacturing difficulty and the manufacturing cost are relatively low. In some embodiments of the present disclosure, there are a plurality of protrusion ribs 74, and the plurality of protrusion ribs 74 are spaced in the width direction of the chassis 1.

In some embodiments of the present disclosure, as shown in FIG. 14, a plurality of protrusion ribs 74 are provided and spaced in the width direction of the chassis 1. It could be understood that, by using the plurality of protrusion ribs 74, the water receiving tray 7 may be limited in a plurality of positions along the width direction of the chassis 1, so that it may be ensured that in a length direction of the water receiving tray 7, the side wall of the water receiving tray 7 facing away from the outdoor part 14 is completely separated from the side wall of the indoor part 13 facing away from the outdoor part 14, to avoid displacement of the water receiving tray 7, thereby ensuring the reliability of relative positions of the water receiving tray 7 and the indoor part 13.

In some embodiments of the present disclosure, as shown in FIG. 15, the protrusion rib 74 and the water receiving tray 7 are formed an integral piece. As a result, the structure of the integral piece may not only ensure the structure and performance stability of the protrusion rib 74 and the water receiving tray 7, but also facilitate the formation and manufacturing. Moreover, redundant assembly parts and connection processes are omitted, greatly improving the assembly efficiency of the protrusion rib 74 and the water receiving tray 7 and ensuring the connection reliability of the protrusion rib 74 and the water receiving tray 7. Furthermore, the overall strength and stability of the integrally formed structure is higher, the assembly is more convenient, and the service life is longer. In some embodiments of the present disclosure, the side wall of the water receiving tray 7 facing away from the outdoor part 14 is provided with a positioning post 73, and the side wall of the indoor part 13 facing away from the outdoor part 14 is provided with a positioning hole 131 fitted with the positioning post 73.

Figure 12:
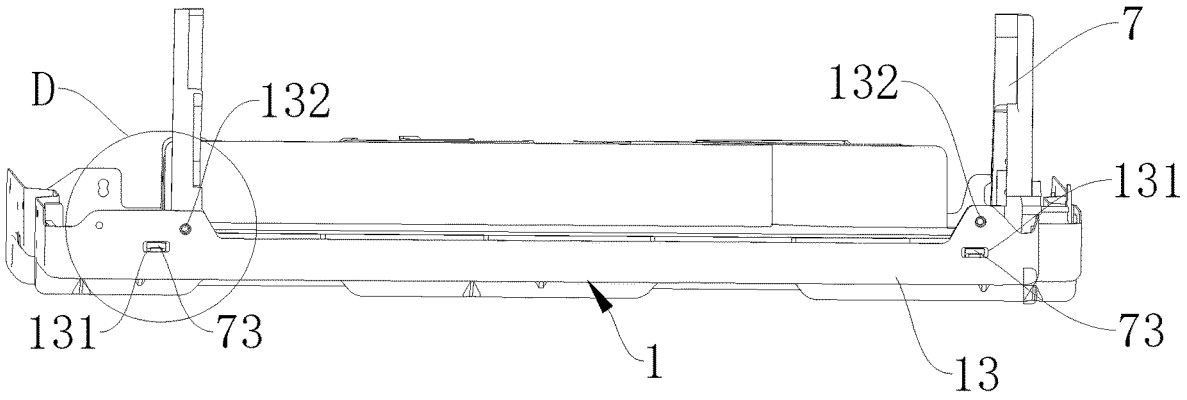
FIG. 12 is a front view of a chassis and a water receiving tray of a window air conditioner according to an embodiment of the present disclosure.
Figure 13:
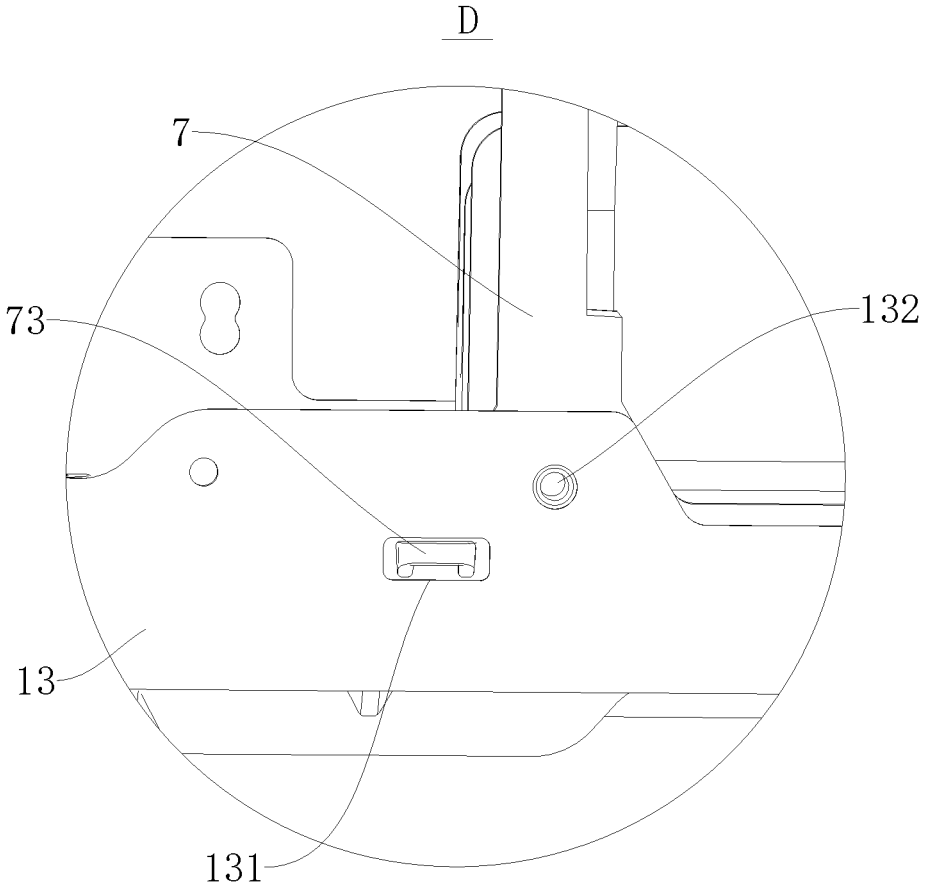
FIG. 13 is an enlarged view of part D in FIG. 12.
Figure 16:
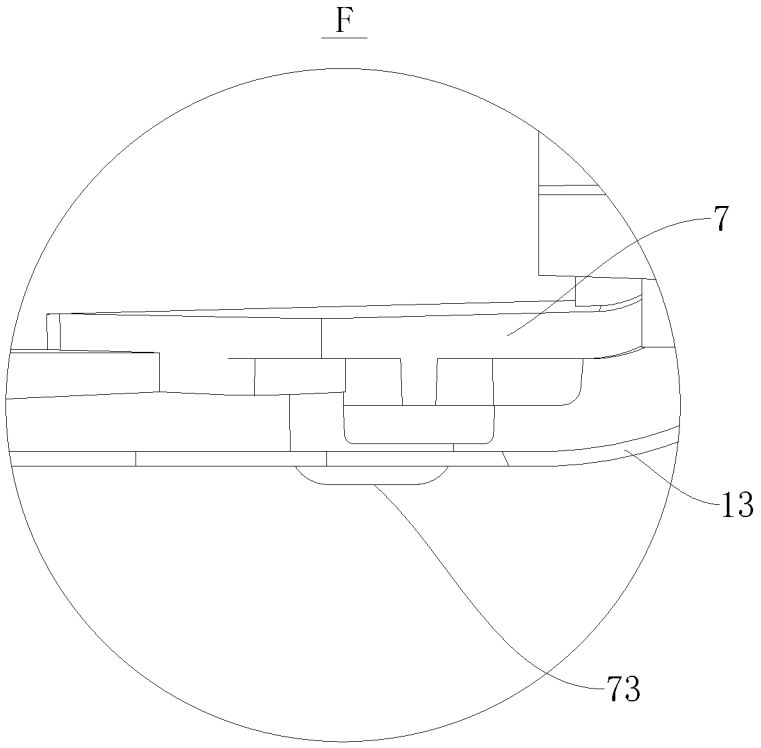
FIG. 16 is an enlarged view of part F in FIG. 14.
Figure 18:
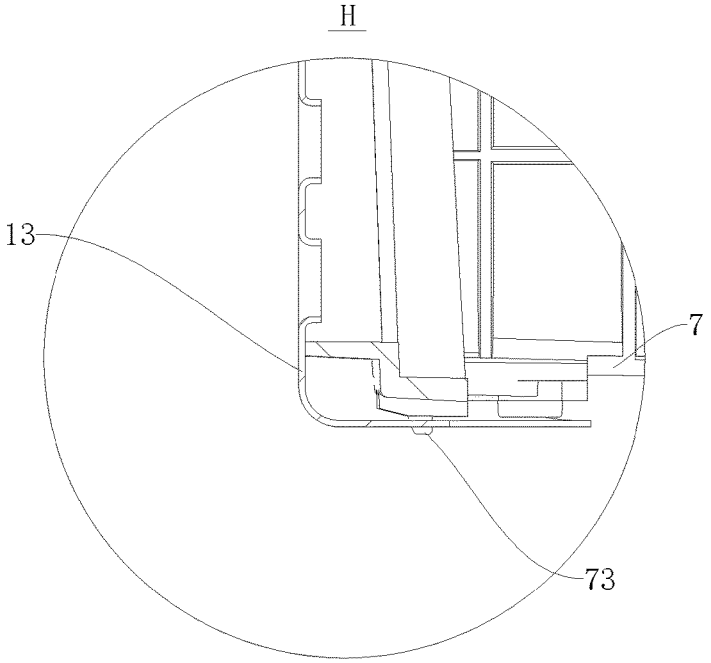
FIG. 18 is an enlarged view of part H in FIG. 17.

In some embodiments of the present disclosure, as shown in FIGS. 13 and 16, the side wall of the water receiving tray 7 facing away from the outdoor part 14 is provided with the positioning post 73 (in combination with FIG. 18), and the side wall of the indoor part 13 facing away from the outdoor part 14 is provided with the positioning hole 131 fitted with the positioning post 73 (in combination with FIG. 12). It could be understood that by using the fitting between the positioning post 73 and the positioning hole 131, the relative positions of the water receiving tray 7 and the indoor part 13 may be limited, and the relative displacement between the water receiving tray 7 and the indoor part 13 may be avoided. Additionally, the fitting between the positioning post 73 and the positioning hole 131 may have an auxiliary positioning effect on the mounting of the water receiving tray 7, which may improve the mounting efficiency and mounting accuracy of the water receiving tray 7.

In some embodiments of the present disclosure, as shown in FIGS. 12 and 13, the side wall of the water receiving tray 7 facing away from the outdoor part 14 includes a first mounting hole, and the side wall of the indoor 13 facing away from the outdoor part 14 is provided with a second mounting hole 132 corresponding to the first mounting hole. The first mounting hole and the second mounting hole 132 are configured to be connected and fixed by a connection member.

It could be understood that, the first mounting hole, the second mounting hole 132, and the connection member may be used to connect and fix the water receiving tray 7 to the indoor part 13. In addition, the first mounting hole, the second mounting hole 132, and the connection member have the advantages of simple structure and easy assembly, and the connection member may realize the tight connection between the water receiving tray 7 and the indoor part 13. Moreover, the cost may be reduced while the connection strength between the water receiving tray 7 and the indoor part 13 is ensured. In some examples of the present disclosure, the connection member may be a screw, a bolt, or a stud.

Figure 17:
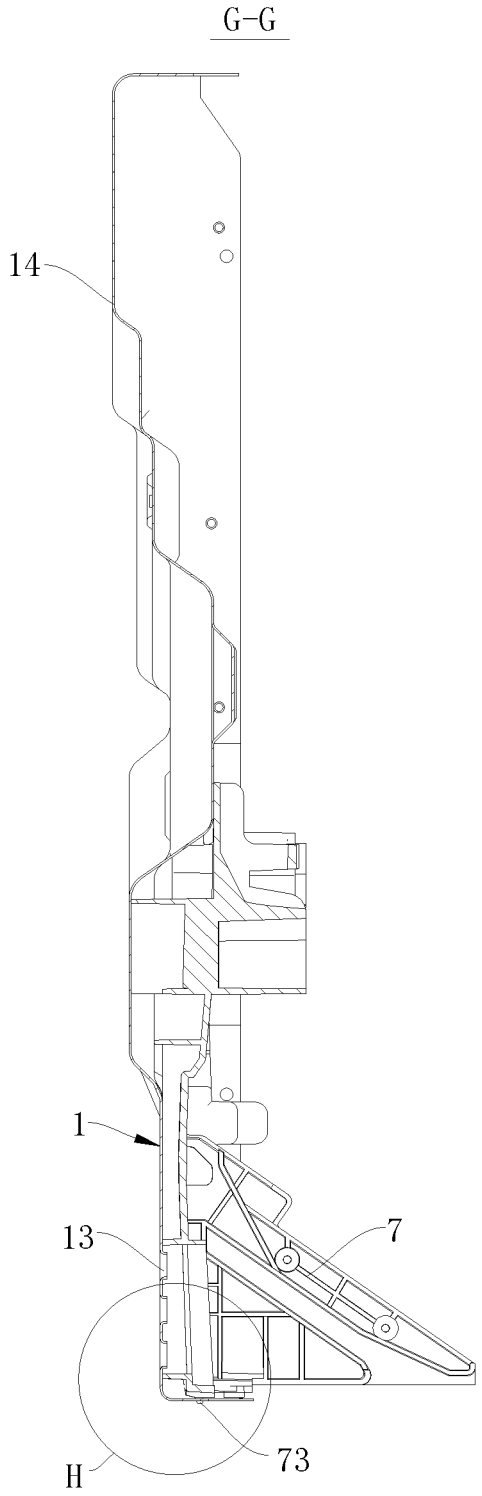
FIG. 17 is a sectional view taken along line G-G in FIG. 14.
Figure 24:
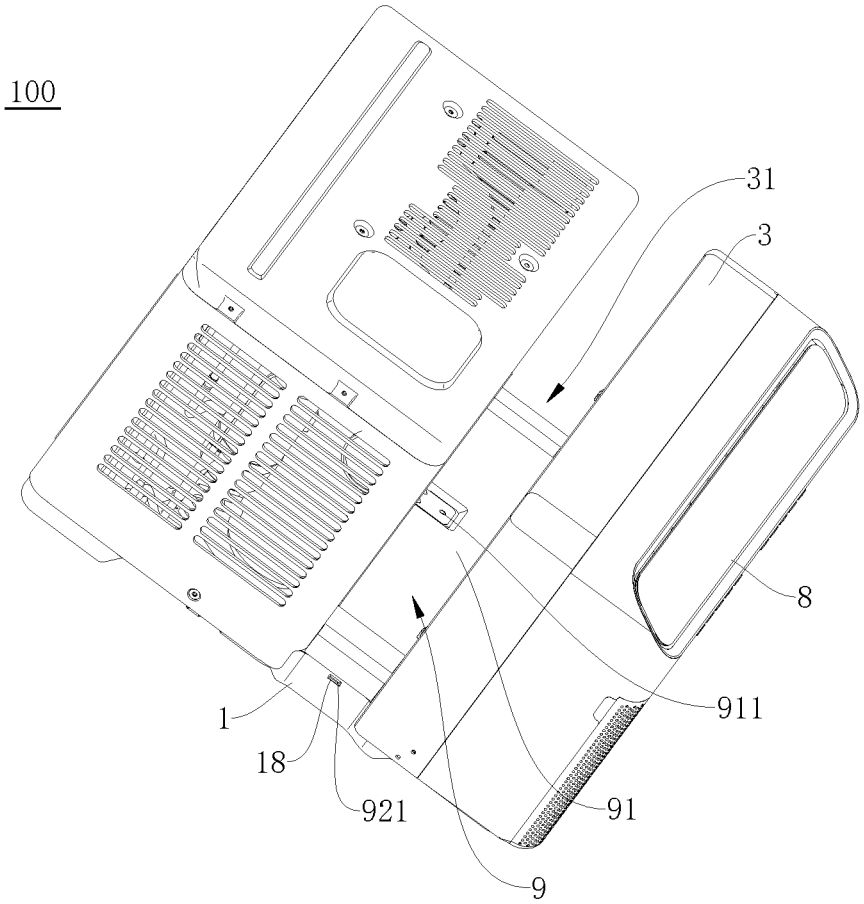
FIG. 24 is a schematic structural diagram of a window air conditioner according to an embodiment of the present disclosure.

In some embodiments of the present disclosure, as shown in FIGS. 14 and 17, the outdoor part 14 includes the drain hole 101, and the drain hole 101 penetrates the chassis 1. The water receiving tray 7 includes a first drain channel 71, and the first drain channel 71 is in communication with the drain hole 101. It could be understood that the condensate water produced by the indoor heat exchanger of the window air conditioner 100 (as shown in FIG. 24) may be received in the water receiving tray 7, and when the condensate water in the water receiving tray 7 reaches a certain volume, the condensate water in the water receiving tray 7 may be discharged to the drain hole 101 through the first drain channel 71 and finally discharged out of the window air conditioner 100 through the drain hole 101. Thus, the condensate water may be prevented from overflowing into the window air conditioner 100, and the operational reliability and safety of the window air conditioner 100 may be ensured.

It should be noted that the first drain channel 71 is corresponding to a heat exchange tube at an edge of the indoor heat exchanger. The condensate water generated by the heat exchange tube drips into the first drain channel 71, then flows to the drain hole 101 through the first drain channel 71, and finally is discharged out of the chassis 1 through the drain hole 101.

In some embodiments of the present disclosure, as shown in FIGS. 14 and 17, the outdoor part 14 also includes the overflow hole 102. The overflow hole 102 penetrates the chassis 1 and is spaced from the drain hole 101. It could be understood that, when there is much water in the chassis 1 and water cannot be discharged from the drain hole 101 in time, the overflow hole 102 may assist the drain hole 101 in drainage, thereby avoiding too much water accumulated in the chassis 1 and further improving the operational reliability of the window air conditioner 100.

As shown in FIG. 14, the outdoor part 14 is also provided with a water storage space 140, one end of the water storage space 140 is in communication with the overflow hole 102, the water receiving tray 7 includes a drain groove 72, and the other end of the water storage space 140 is in communication with the drain groove 72. It should be noted that the window air conditioner 100 may include the supercooling tube 4, the water storage space 140 may be used to store the condensate water, and a high-temperature and high-pressure refrigerant discharged from an outlet of an outdoor heat exchanger of the window air conditioner 100 may exchange heat with the condensate water in the water storage space 140 through the supercooling tube 4 and then enters a capillary tube. Thus, the working efficiency of the window air conditioner 100 may be improved. For example, in an example of the present disclosure, the water storage space 140 includes the first water storage tank 141 and the second water storage tank 142, the second water storage tank 142 is disposed at the side of the first water storage tank 141 close to the indoor part 13, and the second water storage tank 142 is in communication with the first water storage tank 141.

Figure 19:
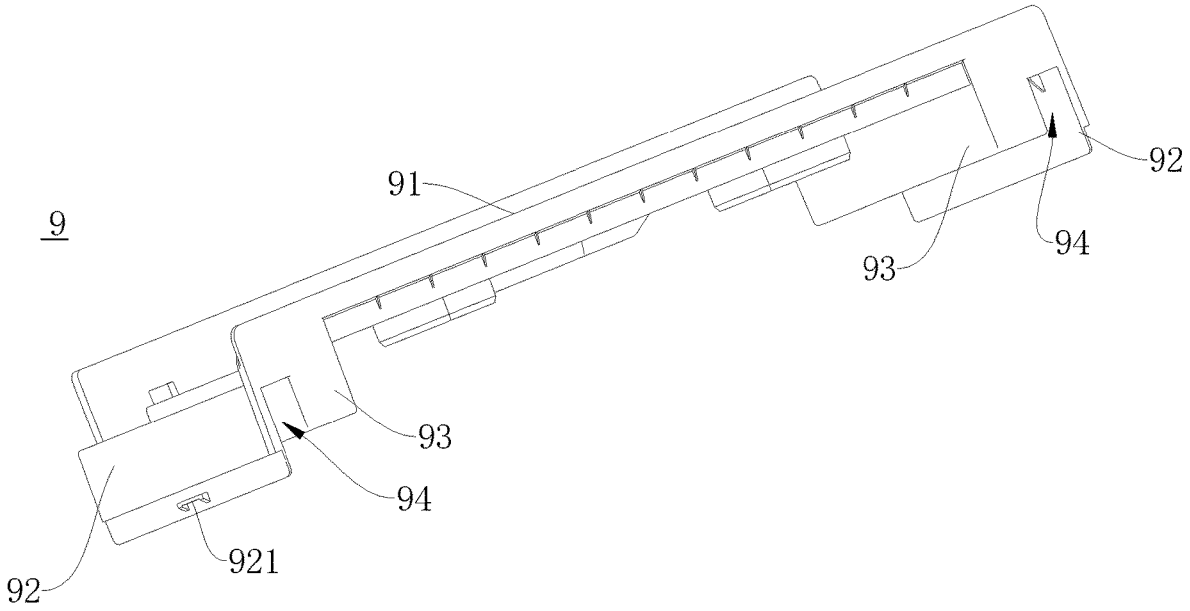
FIG. 19 is a perspective view of a middle partition plate of a window air conditioner according to an embodiment of the present disclosure.
Figure 20:
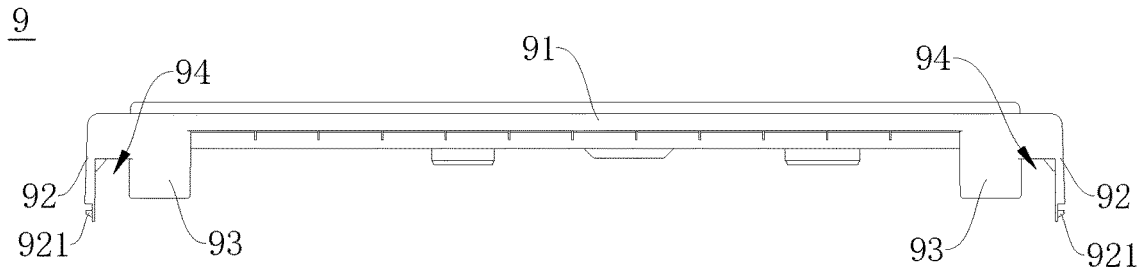
FIG. 20 is a front view of a middle partition plate of a window air conditioner according to an embodiment of the present disclosure.
Figure 22:
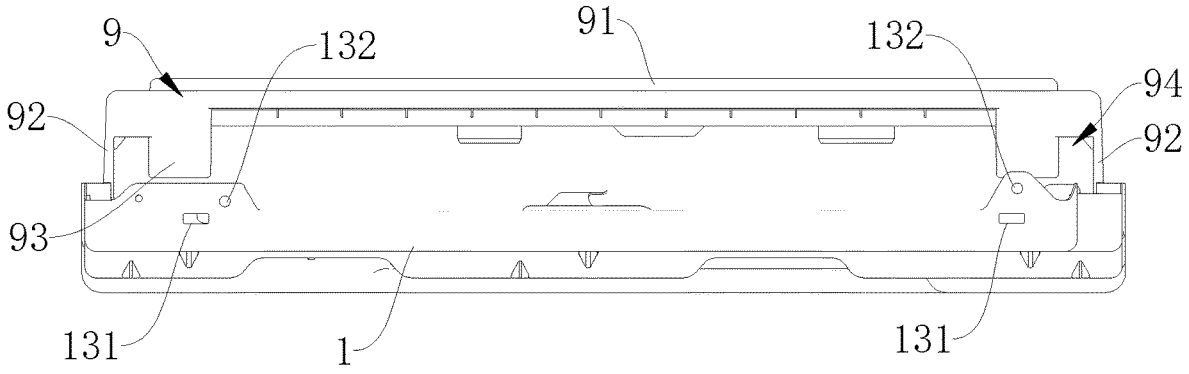
FIG. 22 is a front view of a chassis and a middle partition plate of a window air conditioner according to an embodiment of the present disclosure.
Figure 23:
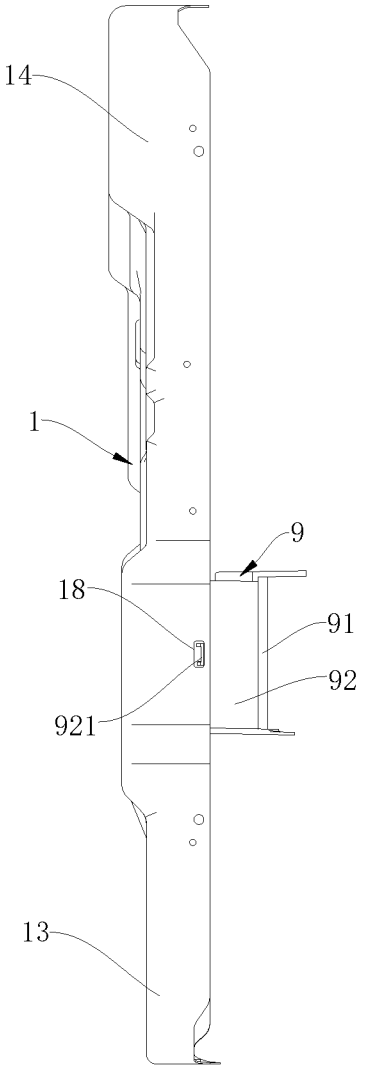
FIG. 23 is a side view of a chassis and a middle partition plate of a window air conditioner according to an embodiment of the present disclosure.

According to some embodiments of the present disclosure, as shown in FIGS. 19 and 20, the window air conditioner 100 (as shown in FIG. 24) further includes a middle partition plate 9. The middle partition plate 9 is fixed on the chassis 1, and the middle partition plate 9 partitions the chassis 1 into the indoor part 13 and the outdoor part 14. For example, in an example of the present disclosure, as shown in FIGS. 22 and 23, the middle partition plate 9 is disposed on the chassis 1, the chassis 1 at a side of the middle partition plate 9 close to the indoor is formed as the indoor part 13, and the chassis 1 at a side of the middle partition plate 9 close to the outdoor is formed as the outdoor part 14. As a result, the indoor part 13 and the outdoor part 14 may be separated to prevent outdoor noise from spreading to the indoor, thereby improving the users' comfort.

In some embodiments of the present disclosure, as shown in FIGS. 19 and 20, the middle partition plate 9 includes: a support plate 91 for supporting a sash 300 (shown in FIG. 26), a first connection plate 92, and a second connection plate 93. There are two first connection plates 92, and respective first ends of the two first connection plates 92 are connected to both ends of the support plate 91, correspondingly. For example, in an example of the present disclosure, an upper end of each first connection plate 92 is connected to the support plate 91, and the two first connection plates 92 are connected to both ends of the support plate 91, correspondingly.

As shown in FIGS. 19 and 20, respective second ends of the two first connection plates 92 are located in the chassis 1 and connected to two opposite side walls of the chassis 1. There are two second connection plates 93, and respective first ends of the two second connection plates 93 are connected to both ends of the support plate 91 in a length direction. The first connection plate 92 and the second connection plate 93 located at the same end are spaced apart from each other, and the second connection plate 93 is located inside the first connection plate 92. The first connection plate 92, the second connection plate 93, and at least a part of the support plate 91 collectively form a mounting groove 94. It could be understood that the mounting groove 94 communicates the indoor part 13 with the outdoor part 14, so that a condenser tube of the window air conditioner 100 may be provided in and pass through the mounting groove 94.

In an example of the present disclosure, as shown in FIGS. 19 and 20, the support plate 91, the first connection plate 92, and the second connection plate 93 are formed an integral piece. Thus, the structure of the integral piece may not only ensure the structure and performance stability of the support plate 91, the first connection plate 92, and the second connection plate 93, but also facilitate the formation and manufacturing. Moreover, redundant assembly parts and connection processes are omitted, greatly improving the assembly efficiency of the support plate 91, the first connection plate 92, and the second connection plate 93 and ensuring the connection reliability of the support plate 91, the first connection plate 92, and the second connection plate 93. Furthermore, the overall strength and stability of the integrally formed structure is higher, the assembly is more convenient, and the service life is longer.

Figure 25:
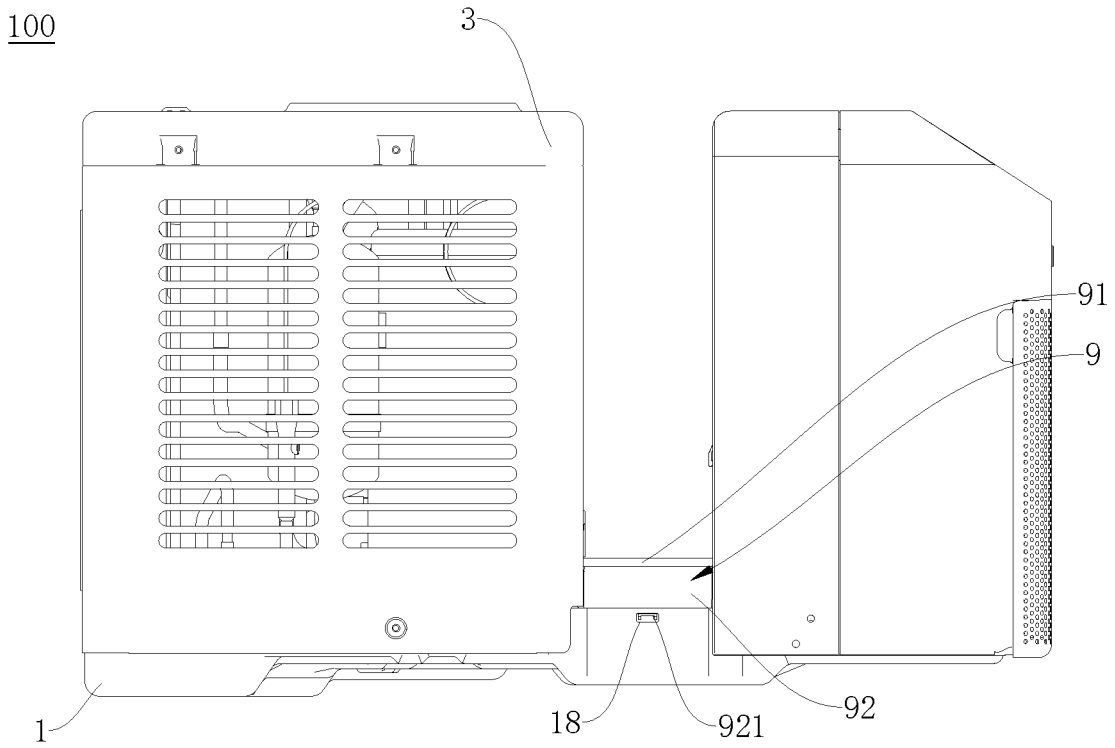
FIG. 25 is a side view of a window air conditioner according to an embodiment of the present disclosure.

In some embodiments of the present disclosure, as shown in FIGS. 23 and 25, a side wall of the chassis 1 is provided with a locking hole 18, and the first connection plate 92 is provided with a locking protrusion 921 fitted with the locking hole 18. It could be understood that by using the fitting between the locking protrusion 921 and the locking hole 18, the relative positions of the middle partition plate 9 and the chassis 1 may be formed, and the relative displacement between the middle partition plate 9 and the chassis 1 may be avoided. Additionally, the fitting between the middle partition plate 9 and the chassis 1 may have an auxiliary positioning effect on the mounting of the middle partition plate 9, which may improve the mounting efficiency and mounting accuracy of the middle partition plate 9.

Figure 21:
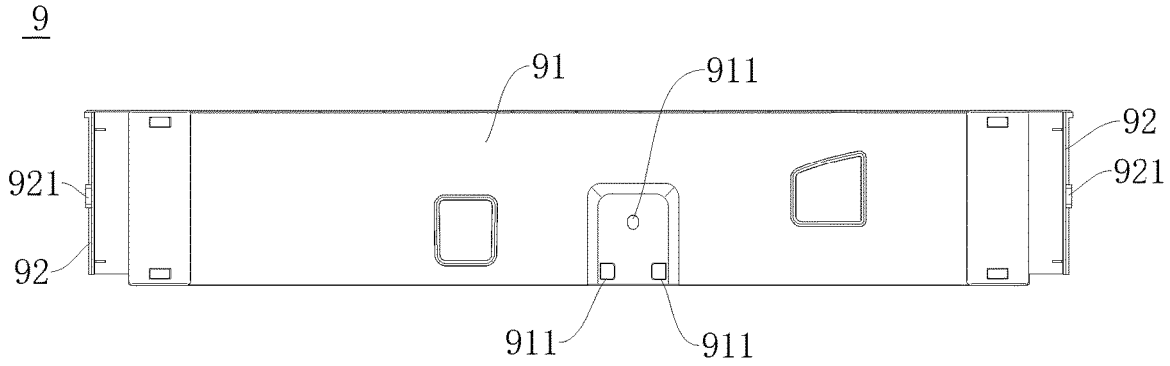
FIG. 21 is a top view of a middle partition plate of a window air conditioner according to an embodiment of the present disclosure.

In some embodiments of the present disclosure, as shown in FIGS. 21 and 24, the support plate 91 includes a third mounting hole 911 for fixing the back panel. It could be understood that the back panel may be fixed on the chassis 1, and the third mounting hole 911 may be provided to reduce the difficulty of fixing the back panel and improve the efficiency of fixing the back panel.

Figure 26:
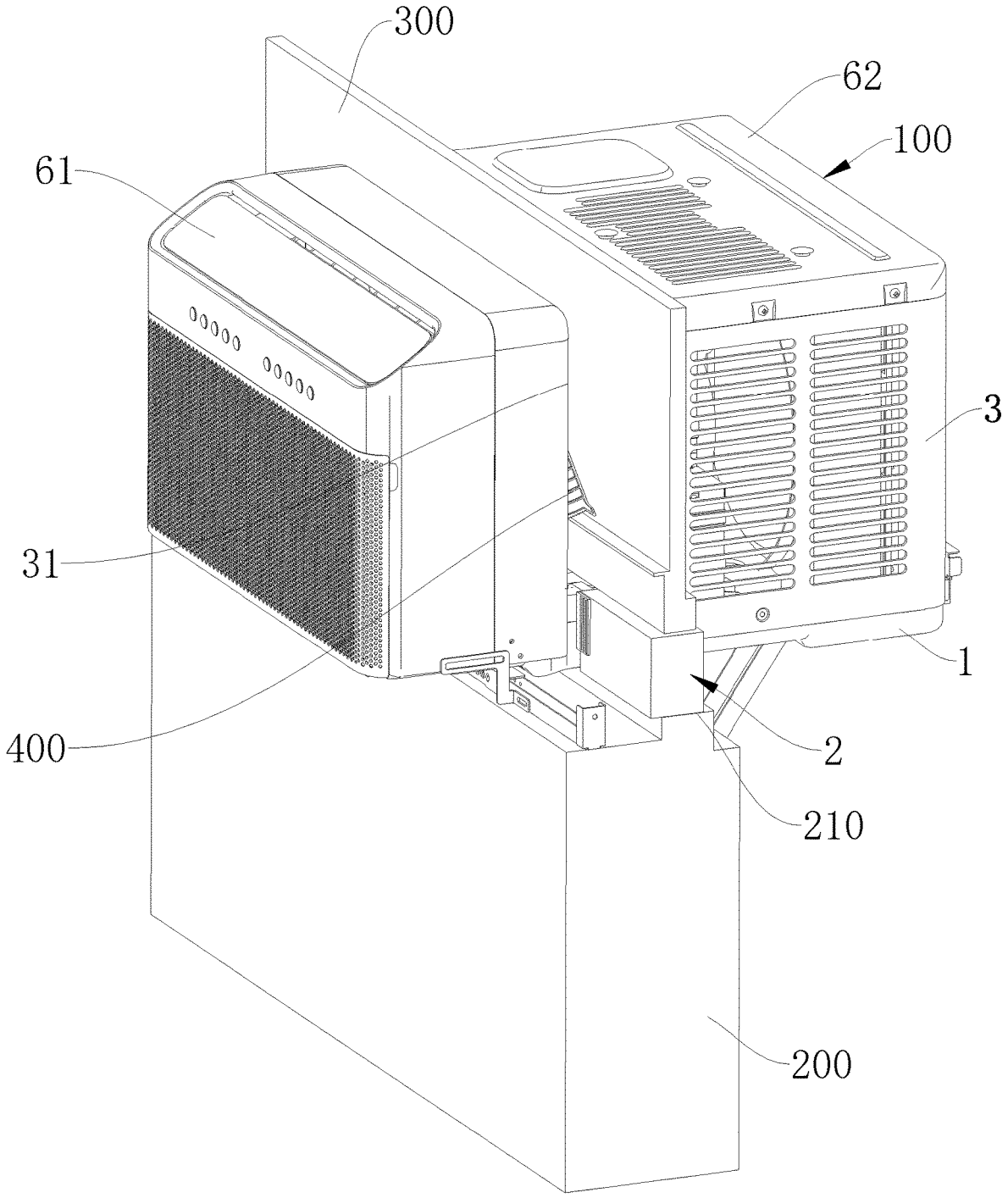
FIG. 26 is a schematic mounting diagram of a window air conditioner according to an embodiment of the present disclosure.
Figure 27:
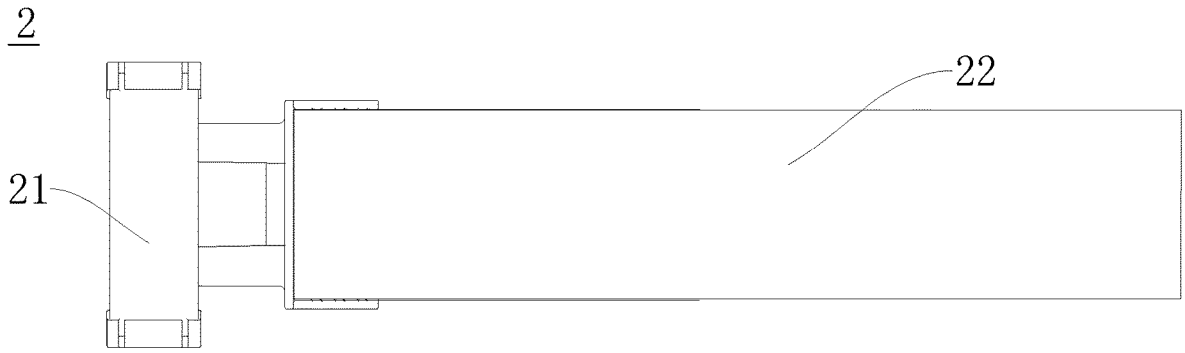
FIG. 27 is a schematic structural diagram of a sealing assembly of a window air conditioner according to an embodiment of the present disclosure.

According to some embodiments of the present disclosure, as shown in FIGS. 26 and 27, the window air conditioner 100 is configured to be supported in a window opening 210 of a wall body 200, and a movable sash 300 is provided in the window opening 210. The window air conditioner 100 further includes a housing 3 connected to the chassis 1. The housing 3 is provided with a receiving slot 31, and at least a part of the window sash 300 may extend into the receiving slot 31.

It could be understood that the housing 3 is divided into a first part located indoors and a second part located outdoors by the receiving slot 31, and at least a part of the window sash 300 may extend into the receiving slot 31. Specifically, in an example of the present disclosure, an indoor heat exchanger and an indoor fan are provided in the first part of the housing 3 located indoors, and an outdoor heat exchanger and an outdoor fan are provided in the second part of the housing 3 located outdoors.

In an example of the present disclosure, the housing 3 includes an indoor housing and an outdoor housing. The indoor housing, the outdoor housing, and the middle partition plate 9 form the receiving slot 31. In an embodiment of the present disclosure, the chassis 1 may be connected to the wall body 200 through the support arm 5 to make the connection between the window air conditioner 100 and the wall body 200 more stable.

In some embodiments of the present disclosure, as shown in FIGS. 26 and 27, the window air conditioner 100 further includes a sealing assembly 2, and the sealing assembly 2 is in contact with the sash 300 and an inner wall of the window opening 210. The sealing assembly 2 includes: a fixing member 21 connected to the housing 3; and a sealing member 22 connected to the fixing member 21. The sealing member 22 is sealingly provided between the sash 300 and the inner wall of the window opening 210.

It could be understood that the sealing member 22 may be connected to the housing 3 through the fixing member 21. In a state where the window sash 300 closes the window opening 210, one side of the sealing member 22 is in contact with the window sash 300, and the other side of the sealing member 22 is in contact with the inner wall of the window opening 210. Sealing the window opening 210 by the sealing member 22 improves the sealing performance of the sealing assembly 2 on the one hand, and makes the sealing assembly 2 have a good sound insulation effect on the other hand.

In some embodiments of the present disclosure, the sealing member 22 is a sealing sponge. The length of the sealing member 22 may be cut in the field according to a distance between a side wall surface of the housing 3 and an inner wall surface of the window opening 210, to allow the sealing member 22 to better seal the window opening 210. While the sealing of the window opening 210 is ensured, the structure of the sealing assembly 2 becomes simpler.

In some embodiments of the present disclosure, the sealing member 22 may be made of PVA polyvinyl alcohol materials, so that the sealing assembly 2 has unique strong adhesion, membrane flexibility, smoothness, oil resistance, solvent resistance, protective colloid property, gas barrier property, abrasion resistance, and water resistance after special treatment, which may prevent outside rainwater from entering the room and improve the waterproofness of the sealing assembly 2.

In some embodiments of the present disclosure, as shown in FIGS. 26 and 27, the window air conditioner 100 further includes a positioning device 400, and the positioning device 400 has an unlocking state and a locking state. In the unlocking state, the positioning device 400 is disengaged from the window sash 300. In the locking state, the positioning device 400 is in contact with the sash 300 to position the sash 300. It could be understood that the positioning device 400 is used to position and lock the window sash 300 to improve the sealing performance and safety. In some embodiments of the present disclosure, the positioning device 400 is rotatable to lock the window sash 300 or unlock the window sash 300, and hence the structure of the positioning device 400 is simpler and more reliable.

A chassis assembly 10 according to embodiments of the present disclosure will be described below with reference to the drawings.

As shown in FIGS. 28-32, the chassis assembly 10 according to the embodiments of the present disclosure is used for the window air conditioner 100. The window air conditioner 100 further includes a back panel 40, a condenser 20, an evaporator, and a throttle device 30 connected between the condenser 20 and the evaporator. The chassis assembly 10 includes a chassis 1 and a supercooling tube 4.

Specifically, the condenser 20 and the evaporator are suitable to be mounted on the chassis 1. The chassis 1 includes an indoor part 13 and an outdoor part 14. The outdoor part 14 includes a first water storage tank 141 extending in a width direction of the chassis 1. The back panel 40 is suitable to be mounted on the outdoor part 14. The supercooling tube 4 is disposed in the first water storage tank 141. The first water storage tank 141 may have condensate water therein. The supercooling tube 4 includes a first end 41 and a second end 42, and the first end 41 is connected to an outlet of the condenser 20. When the window air conditioner 100 to which the chassis assembly 10 is applicable is cooling or heating, a refrigerant in the condenser 20 exchanges heat with the ambient air where the condenser 20 is located, then flows out from the outlet of the condenser 20 and into the supercooling tube 4 from the first end 41 of the supercooling tube 4. The second end 42 is connected to an inlet of the throttle device 30. After the refrigerant in the supercooling tube 4 exchanges heat with the condensate water in the first water storage tank 141, the refrigerant flows out of the supercooling tube 4 via the second end 42 and flows into the throttle device 30 from the inlet of the throttle device 30. The first end 41 and the second end 42 are located at the same end of the chassis 1 in the width direction. The supercooling tube 4 extends from a first end of the chassis 1 in the width direction to a second end of the chassis 1 in the width direction, and then bends back to the first end of the chassis 1 in the width direction. Thus, the length of the supercooling tube 4 may be increased to allow the refrigerant flowing through the supercooling tube 4 to better exchange heat with the condensate water in the first water storage tank 141, thereby further reducing the temperature of the refrigerant in the supercooling tube 4. A portion of the supercooling tube 4 close to the indoor part 13 includes a bent segment 43 that is bent toward the indoor part 13, such that the length of the supercooling tube 4 may be further increased, and the refrigerant flowing through the cooling tube 4 may better exchange heat with the condensate water in the first water storage tank 141, thereby further reducing the temperature of the refrigerant in the supercooling tube 4.

For the chassis assembly 10 according to the embodiments of the present disclosure, since the portion of the supercooling tube 4 close to the indoor part 13 includes the bent segment 43 that is bent toward the indoor part 13, the length of the supercooling tube 4 may be further increased, and a heat exchange area of the refrigerant may be enlarged, such that the refrigerant flowing through the cooling tube 4 may better exchange heat with the condensate water in the first water storage tank 141, and the temperature and pressure of the refrigerant in the supercooling tube 4 may be further lowered, which allows the temperature to be lower when the refrigerant enters the throttle device 30. When the window air conditioner 100 to which the chassis assembly 10 is applicable is cooling, an evaporation temperature of the refrigerant in the evaporator may be lower, increasing a temperature difference between the evaporation temperature and the indoor ambient temperature, and the temperature of the refrigerant when entering the throttle device 30 may be further reduced, further improving the cooling capacity of the window air conditioner 100.

Figure 28:
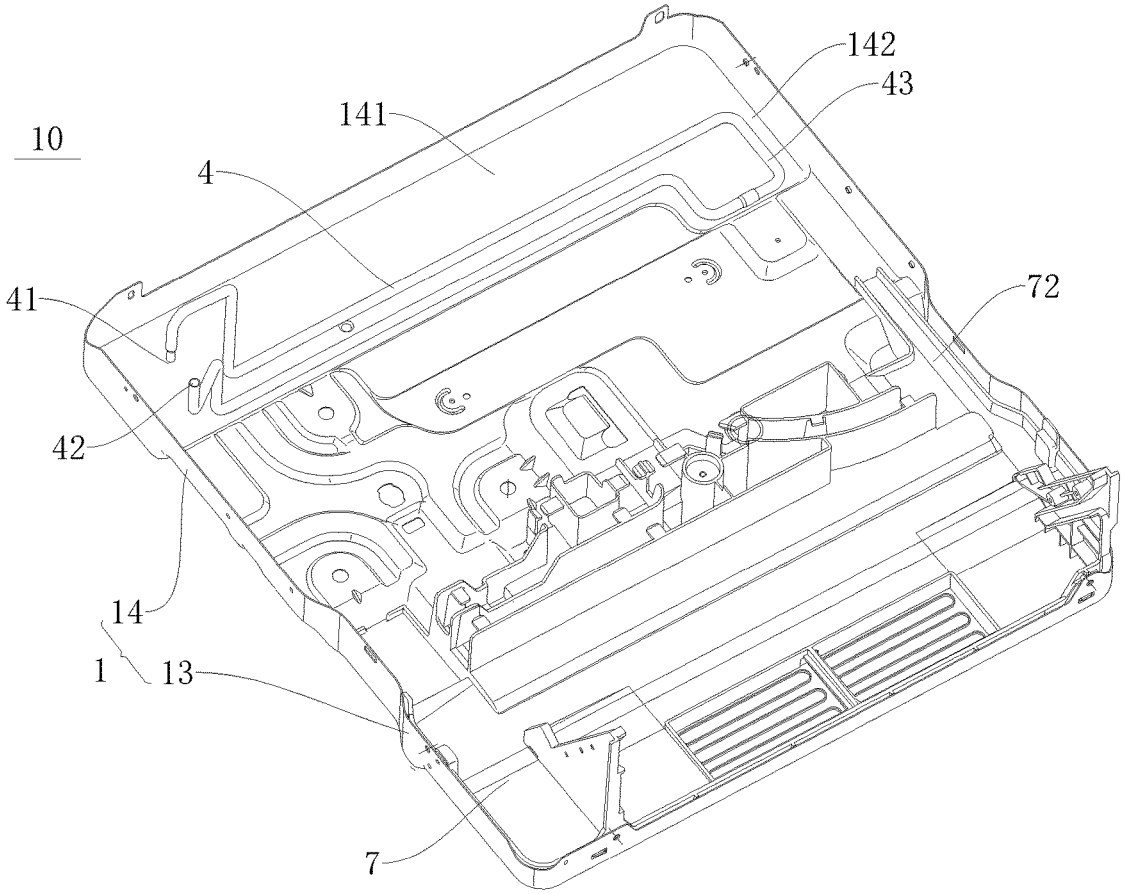
FIG. 28 is a perspective view of a chassis assembly according to an embodiment of the present disclosure.
Figure 30:
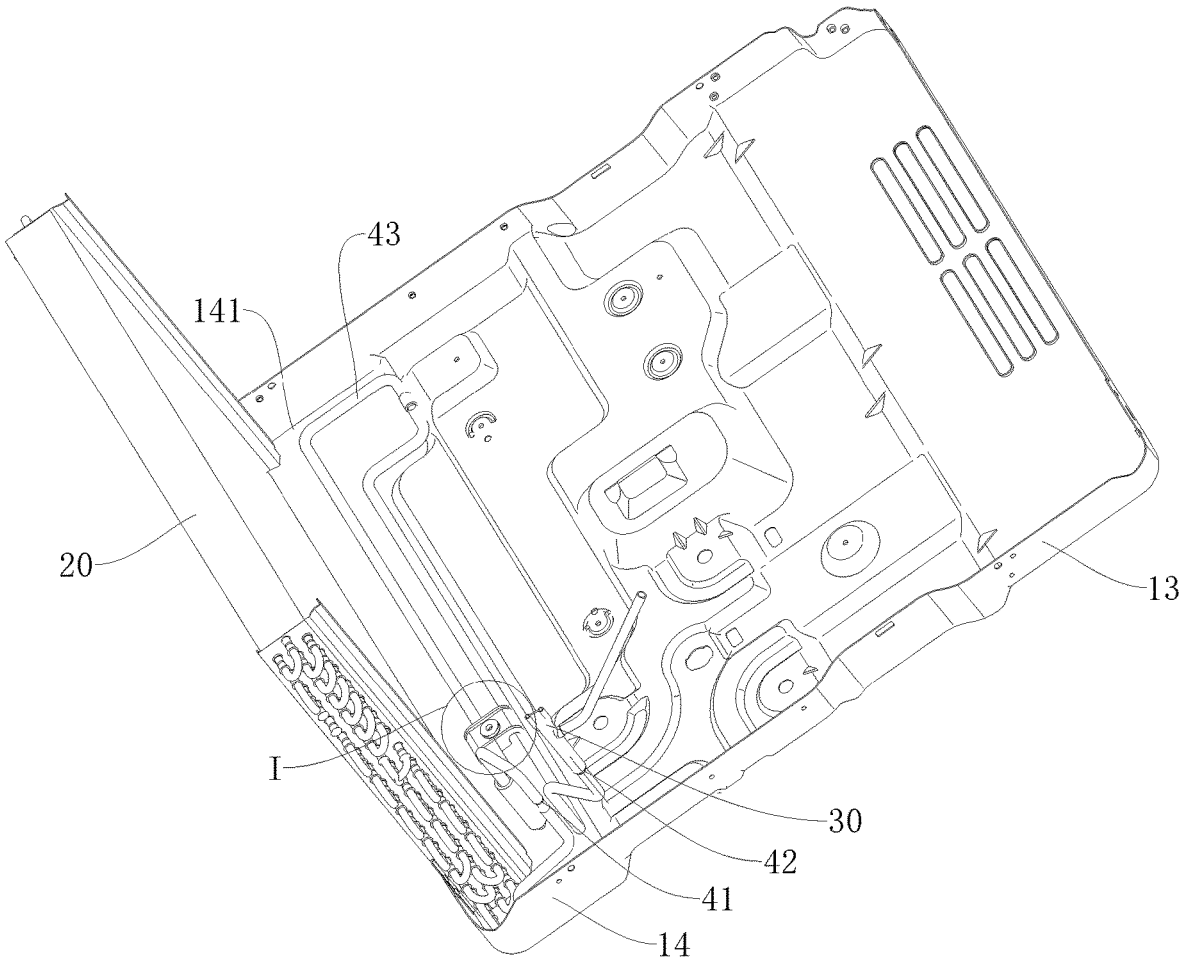
FIG. 30 is a perspective view of a partial structure of a window air conditioner according to an embodiment of the present disclosure.

According to some embodiments of the present disclosure, as shown in FIG. 28 and FIG. 30, the bent segment 43 is located in a position where the supercooling tube 4 bends back. Thus, the structural design may be simplified, and the refrigerant flowing through the supercooling tube 4 may better exchange heat with the condensate water in the first water storage tank 141. When the window air conditioner 100 to which the chassis assembly 10 is applicable is cooling, the cooling capacity of the window air conditioner 100 may be further improved.

Figure 32:
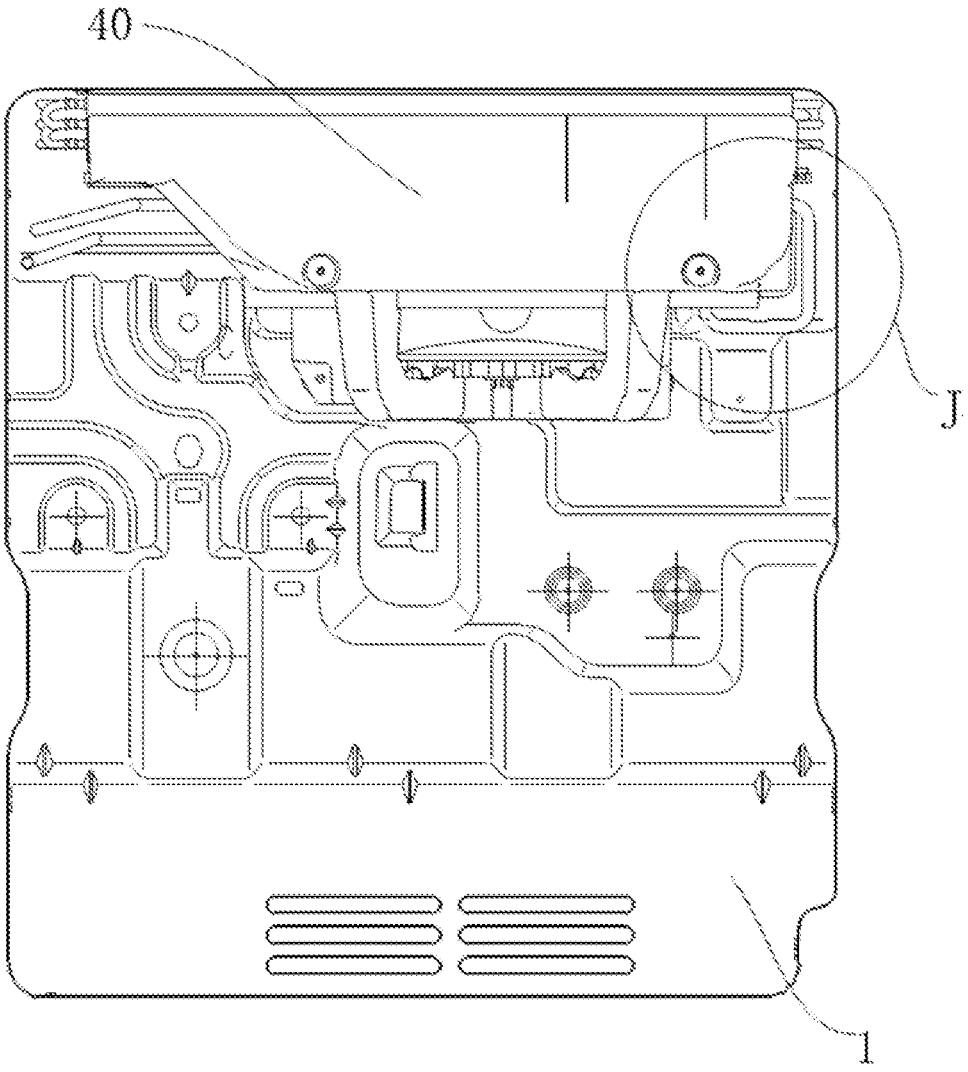
FIG. 32 is a top view of a partial structure of a window air conditioner according to an embodiment of the present disclosure.
Figure 33:
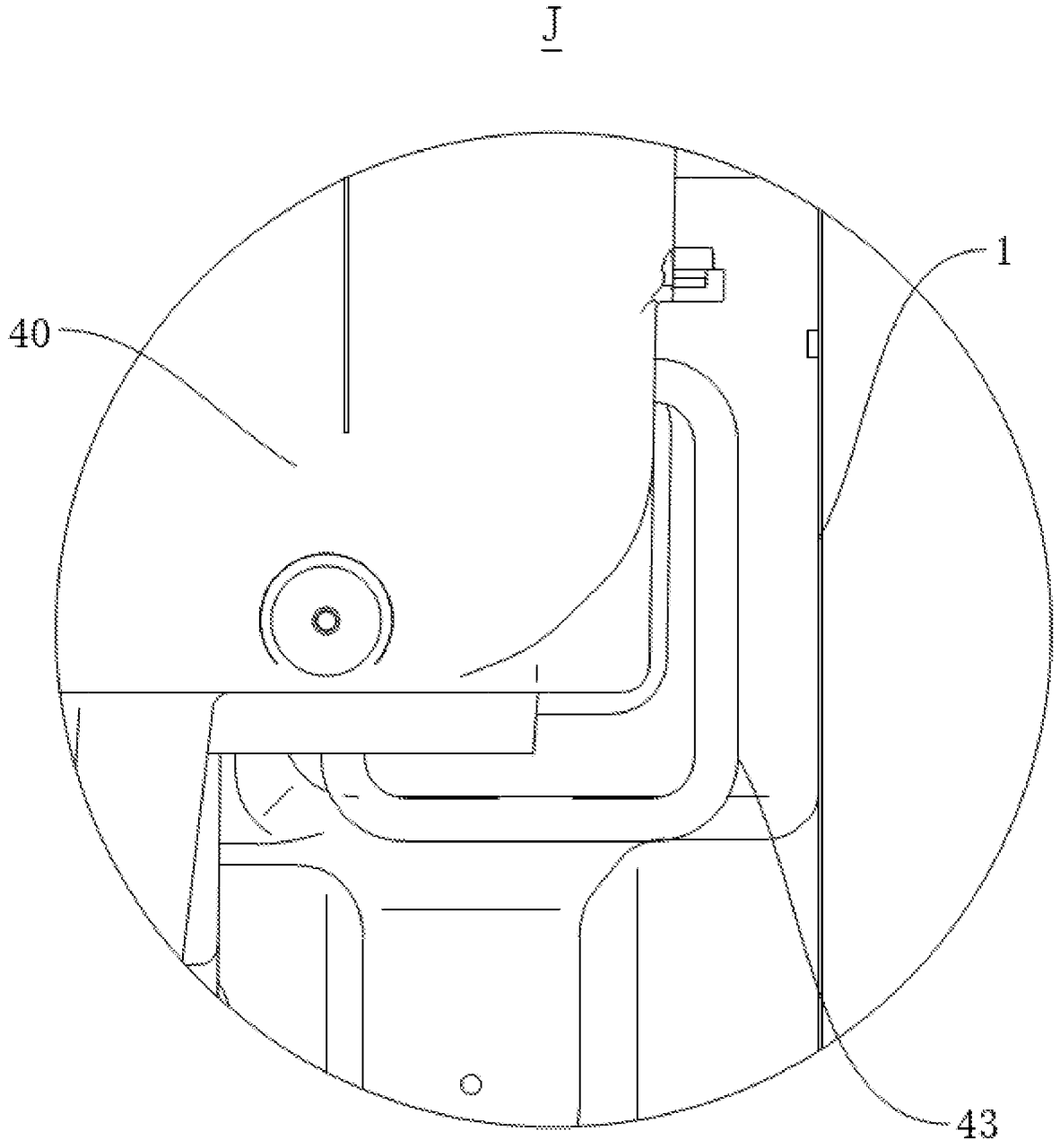
FIG. 33 is an enlarged view of part J in FIG. 32.

According to some embodiments of the present disclosure, as shown in FIGS. 30, 32 and 33, the bent segment 43 extends beyond a side of the back panel 40 close to the indoor part 13. Thus, viewed in a direction from the indoor side to the outdoor side, it may be easily observed whether the bent segment 43 is soaked in water. The possibility that the bent segment 43 is blocked by the back panel 40 from sight is reduced, and it is possible to judge whether the supercooling tube 4 is soaked in water.

According to some embodiments of the present disclosure, as shown in FIG. 28, a second water storage tank 142 is provided at the side of the first water storage tank 141 close to the indoor part 13. The second water storage tank 142 is in communication with the first water storage tank 141. The bent segment 43 is located in the second water storage tank 142. Thus, the possibility of interference between the bent segment 43 and other components may be further reduced, and a bending length of the bent segment 43 may be further increased, thereby increasing the length of the supercooling tube 4, which may allow the refrigerant flowing through the supercooling tube 4 to better exchange heat with the condensate water in the first water storage tank 141 and further lower the temperature of the refrigerant in the supercooling tube 4.

Figure 29:
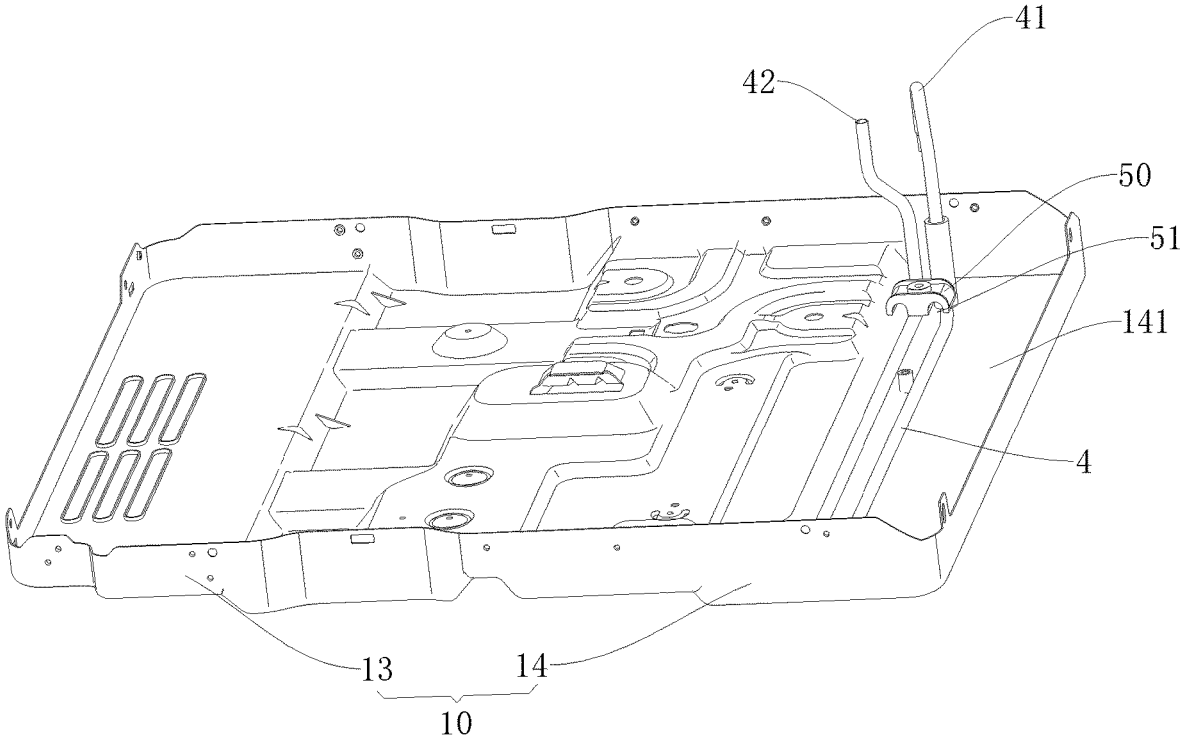
FIG. 29 is a perspective view of a chassis assembly according to an embodiment of the present disclosure from another angle of view.
Figure 31:
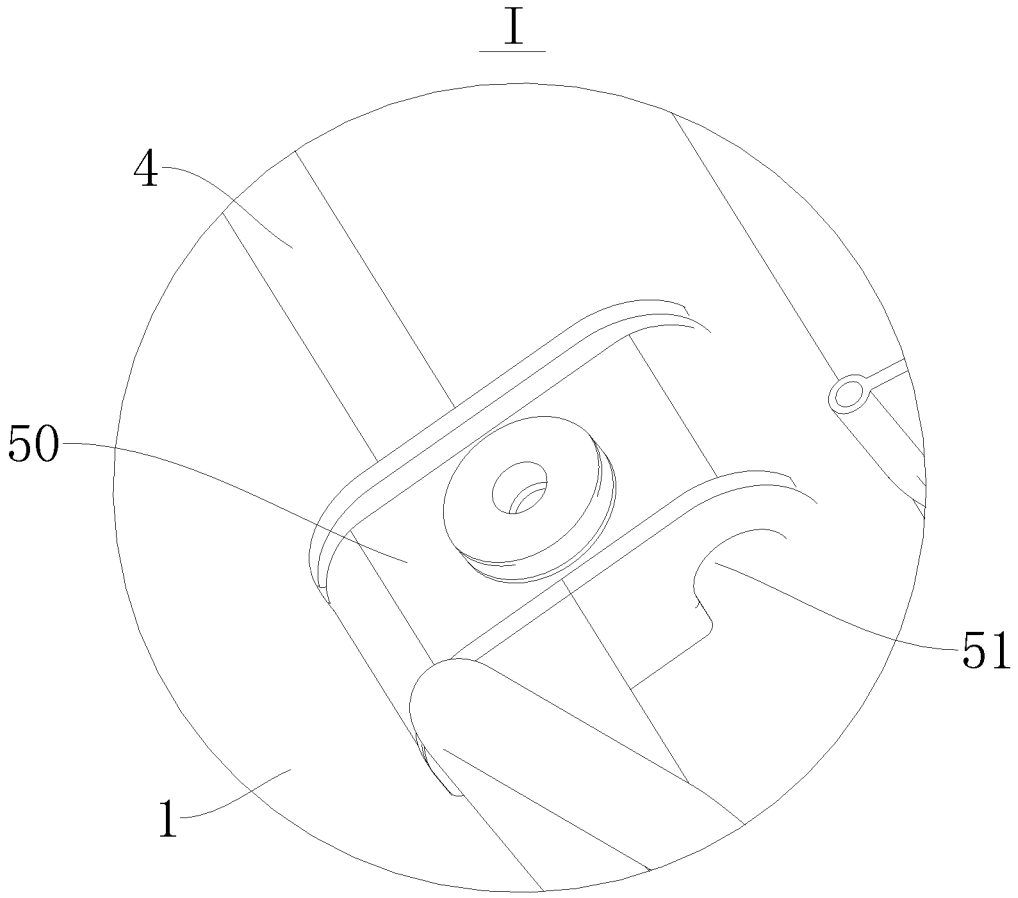
FIG. 31 is an enlarged view of part I in FIG. 30.

According to some embodiments of the present disclosure, as shown in FIGS. 29-31, the chassis assembly 10 further includes a tube clamp 50 connected to a bottom wall of the first water storage tank 141. A side of the tube clamp 50 facing the bottom wall of the first water storage tank 141 is provided with two tube grooves 51 spaced apart from each other. An inner wall of the tube groove 51 and the bottom wall of the first water storage tank 141 jointly form a tube hole, and the supercooling tube 4 is disposed in and passes through the tube hole. Thus, the possibility that the supercooling tube 4 shakes relative to the first water storage tank 141 may be reduced, and the structural stability of the chassis assembly 10 may be enhanced.

It should be noted that the tube clamp 50 and the bottom wall of the first water storage tank 141 may be integrally formed or may be detachably connected. However, the present disclosure is not limited thereto.

In some embodiments of the present disclosure, the tube clamp 50 and the bottom wall of the first water storage tank 141 are connected by a fastener, which may further facilitate the mounting and detachment of the supercooling tube 4 in the first water storage tank 141 and facilitate subsequent maintenance and replacement.

It should be noted that the fastener may be a screw.

According to some embodiments of the present disclosure, as shown in FIGS. 29 and 30, the supercooling tube 4 is provided at an end of the first water storage tank 141 close to the indoor part 13, the first end 41 of the supercooling tube 4 is connected to the outlet of the condenser 20, and the second end 42 of the supercooling tube 4 is connected to the inlet of the throttle device 30. Considering the positions of the back panel 40, the condenser 20, and the throttle device 30 comprehensively, such an arrangement may simplify the design of the supercooling tube 4 and designs of various components.

According to some embodiments of the present disclosure, as shown in FIG. 28, the chassis assembly 10 further includes a water receiving tray 7. The water receiving tray 7 is provided in the indoor part 13 and is in communication with the first water storage tank 141, such that the condensate water in the water receiving tray 7 may more easily flow into the first water storage tank 141 to cool the supercooling tube 4. By use of the condensate water, the temperature of the refrigerant in the supercooling tube 4 is further reduced.

In some embodiments of the present disclosure, as shown in FIG. 28, the water receiving tray 7 includes a drain groove 72, and the drain groove 72 is corresponding to the bent segment 43, so that the condensate water in the water receiving tray 7 may be more easily guided to the bent segment 43, and the supercooling effect of the supercooling tube 4 on the refrigerant may be enhanced.

The window air conditioner 100 according to some embodiments of the present disclosure will be described below with reference to the drawings.

Figure 34:
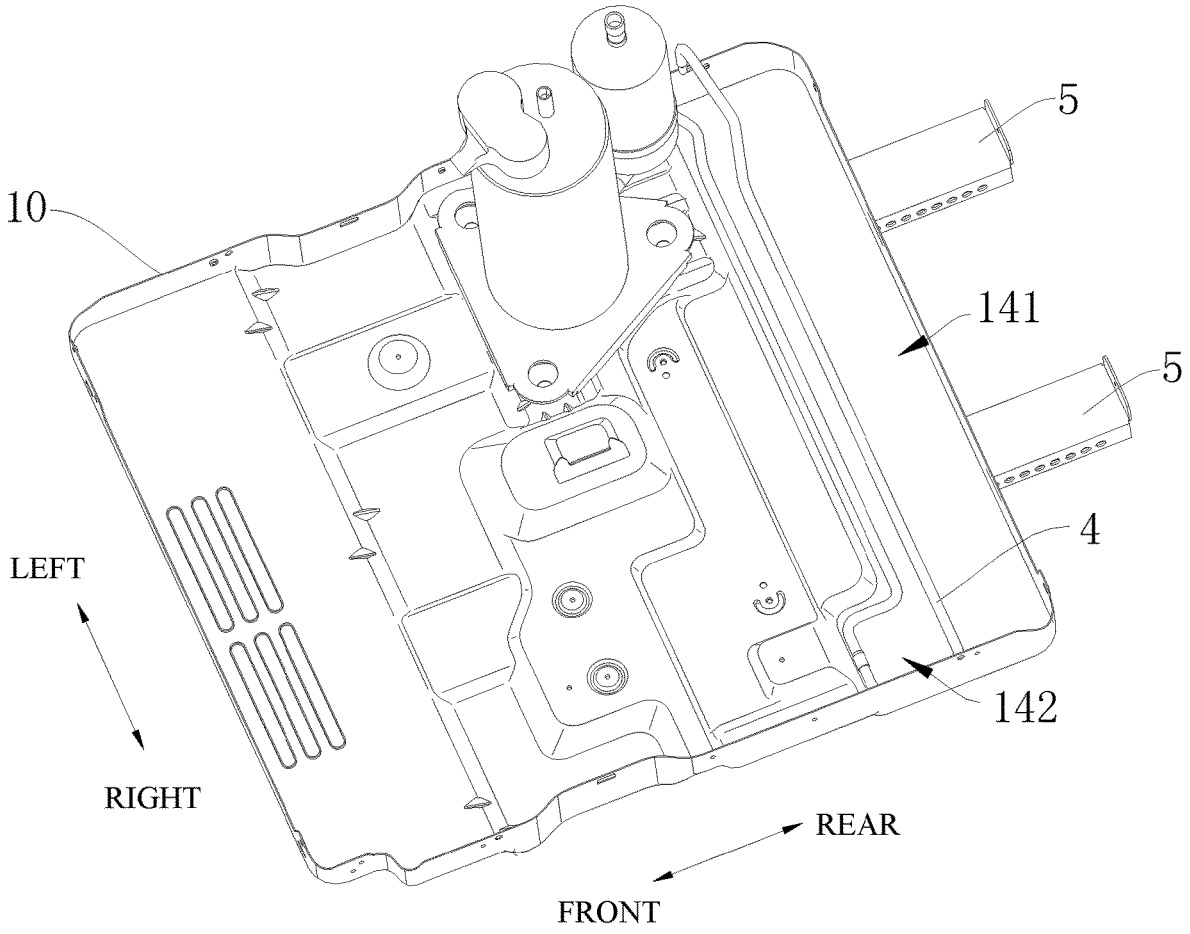
FIG. 34 is a perspective view of another partial structure of a window air conditioner according to an embodiment of the present disclosure.

As shown in FIGS. 26 and 34, the window air conditioner 100 according to embodiments of the present disclosure is configured to be supported in a window opening 210 of a wall body 200, and a movable sash 300 is provided in the window opening 210. The window air conditioner 100 includes the chassis assembly 10 according to in any one of the above embodiments and a housing 3. The housing 3 is connected to the chassis 1 and provided with a receiving slot 31, and at least a part of the window sash 300 may extend into the receiving slot 31.

It could be understood that the housing 3 is divided into an indoor portion 61 and an outdoor portion 62 by the receiving slot 31, and at least a part of the window sash 300 may extend into the receiving slot 31.

In an embodiment of the present disclosure, as shown in FIG. 34, the chassis 1 may be connected to the wall body 200 through the support arm 5 to make the connection between the window air conditioner 100 and the wall body 200 more stable.

In an embodiment of the present disclosure, as shown in FIG. 26, the receiving slot 31 is recessed downward from a top wall of the housing 3. As a result, the window air conditioner 100 may be stressed more uniformly, and a top wall of the window air conditioner 100 may be protected from being damaged due to excess stress, so as to improve the mounting reliability and working performance of the window air conditioner 100. Moreover, an air outlet of the window air conditioner 100 may be set at a higher position, which is conductive to the flowing of the output air indoors, thereby improving the temperature adjustment efficiency of the window air conditioner 100 and the temperature adjustment effect of the window air conditioner 100 on the indoor temperature.

In the window air conditioner 100 according to embodiments of the present disclosure, the first end 41 and the second end 42 of the supercooling tube 4 in the chassis assembly 10 are located at the same end of the chassis 1 in the width direction; the supercooling tube 4 extends from the first end of the chassis 1 in the width direction to the second end of the chassis 1 in the width direction, and then bends back to the first end of the chassis 1 in the width direction. Thus, the length of the supercooling tube 4 may be further increased, and the heat exchange area of the refrigerant may be enlarged, which allows the refrigerant flowing through the supercooling tube 4 to better exchange heat with the condensate water in the first water storage tank 141, thereby further reducing the temperature of the refrigerant in the supercooling tube 4, and further lowering the temperature of the refrigerant when entering the throttle device 30. As a result, the evaporation temperature of the refrigerant in the evaporator may be lower, and the temperature difference between the evaporation temperature and the indoor ambient temperature may be increased, thereby further improving the cooling capacity of the window air conditioner 100.

In some embodiments of the present disclosure, as shown in FIGS. 26 and 27, the window air conditioner 100 further includes a sealing assembly 2, and the sealing assembly 2 is configured to be in contact with the sash 300 and an inner wall of the window opening 210. The sealing assembly 2 includes a fixing member 21 and a sealing member 22. Specifically, the fixing member 21 is connected to the housing 3; the sealing member 22 is connected to the fixing member 21; and the sealing member 22 is sealingly provided between the sash 300 and the inner wall of the window opening 210.

It could be understood that the sealing member 22 may be connected to the housing 3 through the fixing member 21. In a state where the window sash 300 closes the window opening 210, one side of the sealing member 22 is in contact with the window sash 300, and the other side of the sealing member 22 is in contact with the inner wall of the window opening 210. Sealing the window opening 210 by the sealing member 22 on the one hand improves the sealing performance of the sealing assembly 2, and on the other hand makes the sealing assembly 2 have a good sound insulation effect.

In some embodiments of the present disclosure, the sealing member 22 is a sealing sponge. The length of the sealing member 22 may be cut in the field according to a distance between a side wall surface of the housing 3 and an inner wall surface of the window opening 210, to allow the sealing member 22 to better seal the window opening 210. While the sealing of the window opening 210 is ensured, the structure of the sealing assembly 2 becomes simpler.

In some embodiments of the present disclosure, the sealing member 22 may be made of polyvinyl alcohol (PVA) materials, so that the sealing assembly 2 has unique strong adhesion, membrane flexibility, smoothness, oil resistance, solvent resistance, protective colloid property, gas barrier property, abrasion resistance, and water resistance after special treatment, which may prevent outside rainwater from entering the room and improve the waterproofness of the sealing assembly 2.

In some embodiments of the present disclosure, as shown in FIG. 26, the window air conditioner 100 further includes a positioning device 400, and the positioning device 400 has an unlocking state and a locking state. In the unlocking state, the positioning device 400 is disengaged from the window sash 300. In the locking state, the positioning device 400 is in contact with the sash 300 to position the sash 300. It could be understood that the positioning device 400 is used to position and lock the window sash 300 to improve the sealing performance and safety. In some embodiments of the present disclosure, the positioning device 400 is rotatable to lock the window sash 300 or unlock the window sash 300, and hence the structure of the positioning device 400 is simpler and more reliable.

In the present disclosure, unless specified or limited otherwise, the terms "mounted," "connected," "coupled" and the like are used broadly, and may be, for example, fixed connections, detachable connections, or integral connections; may also be mechanical or electrical connections; may also be direct connections or indirect connections via intervening structures; may also be inner communications or interaction of two elements, which could be understood by those skilled in the art according to specific situations.

In the description of the present specification, reference throughout this specification to "an embodiment," "some embodiments," "an example," "a specific example" or "some examples" means that a particular feature, structure, material, or characteristic described in connection with the embodiment or example is included in at least one embodiment or example of the present disclosure. Thus, the appearances of the above phrases throughout this specification are not necessarily referring to the same embodiment or example of the present disclosure. Furthermore, the particular features, structures, materials, or characteristics may be combined in any suitable manner in one or more embodiments or examples. In addition, those skilled in the art may combine and incorporate different embodiments or examples described in this specification.

Although some embodiments of the present disclosure have been shown and described, it would be appreciated by those skilled in the art that changes, modifications, alternatives and variations may be made in the embodiments without departing from the principles and purposes of the present disclosure. The scope of the invention is defined by the claims and the like.

What is claimed is:

1. A chassis for a window air conditioner comprising:

an indoor part including an air inlet hole at a bottom wall of the indoor part, the air inlet hole penetrating the chassis in a thickness direction of the indoor part; and an outdoor part arranged relative to the indoor part along a length direction of the chassis, the outdoor part including a drain hole and an overflow hole that are spaced apart from each other and penetrate the chassis in a same direction;

wherein:

an avoidance groove is provided at a lower surface of the chassis, recessed upward, and extends along the length direction of the chassis;

a support arm is mounted to the lower surface and received in the avoidance groove, the support arm being configured to connect the chassis to a wall; and the overflow hole, the drain hole, and the avoidance groove are arranged along the length direction of the chassis.

2. The chassis according to claim 1, wherein the air inlet hole has a long strip shape.

3. The chassis according to claim 1, wherein the indoor part further includes an annular water blocking member at an upper surface of the bottom wall and around the air inlet hole.

4. The chassis according to claim 1, wherein:

the overflow hole and the drain hole are arranged along the length direction of the chassis; and the drain hole is located at a side of the overflow hole away from the indoor part.

5. The chassis according to claim 1, further comprising:

a reinforcement rib formed by a portion of the chassis protruding upward;

wherein:

the outdoor part includes a mounting platform at an upper surface of a bottom wall of the outdoor part and configured to mount a compressor; and the reinforcement rib extends in a peripheral direction of the mounting platform and is spaced apart from the mounting platform.

6. The chassis according to claim 5, wherein the reinforcement rib surrounds a portion of the mounting platform in the peripheral direction of the mounting platform.

7. The chassis according to claim 5, further comprising:

a connection rib formed by another portion of the chassis protruding upward, one end of the connection rib being connected to the mounting platform, and another end of the connection rib being connected to the reinforcement rib.

8. The chassis according to claim 5, wherein the outdoor part includes a water storage tank spaced apart from the mounting platform.

9. The chassis according to claim 8, wherein the water storage tank extends in a width direction of the chassis and extends from one end of the chassis in the width direction to another end of the chassis in the width direction.

10. The chassis according to claim 9, wherein:

the water storage tank is a first water storage tank; and the outdoor part further includes a second water storage tank provided at a side of the first water storage tank close to the indoor part, the second water storage tank being in communication with the first water storage tank.

11. The chassis according to claim 10, wherein the second water storage tank is located at an end of the first water storage tank in the width direction of the chassis.

12. A chassis assembly for a window air conditioner comprising:

a chassis configured to support a condenser and an evaporator of the window air conditioner, the chassis including:

an indoor part including an air inlet hole at a bottom wall of the indoor part, the air inlet hole penetrating the chassis in a thickness direction of the indoor part; and an outdoor part arranged relative to the indoor part along a length direction of the chassis, the outdoor part including a drain hole and an overflow hole that are spaced apart from each other and penetrate the chassis in a same direction; and a supercooling tube extending from a first end of the chassis in a width direction of the chassis to a second end of the chassis in the width direction and bending back to the first end of the chassis in the width direction, a first end of the supercooling tube being configured to be connected to an outlet of the condenser, a second end of the supercooling tube being configured to be connected to an inlet of a throttle device of the window air conditioner, and the supercooling tube including a bent segment close to the indoor part and being bent toward the indoor part;

wherein:

an avoidance groove is provided at a lower surface of the chassis, recessed upward, and extends along the length direction of the chassis;

a support arm is mounted to the lower surface and received in the avoidance groove, the support arm being configured to connect the chassis to a wall; and the overflow hole, the drain hole, and the avoidance groove are arranged along the length direction of the chassis.

13. The chassis assembly according to claim 12, wherein:

the outdoor part includes a water storage tank extending in the width direction of the chassis and extending from one end of the chassis in the width direction to another end of the chassis in the width direction; and the supercooling tube is provided in the water storage tank.

14. The chassis assembly according to claim 13, wherein:

the water storage tank is a first water storage tank;

the outdoor part further includes a second water storage tank provided at a side of the first water storage tank close to the indoor part, the second water storage tank being in communication with the first water storage tank; and the bent segment is located in the second water storage tank.

15. The chassis assembly according to claim 13, further comprising:

a water receiving tray provided at the indoor part and communicating with the water storage tank.

16. The chassis assembly according to claim 15, wherein the water receiving tray includes a drain groove corresponding to the bent segment.

17. A window air conditioner comprising:

a chassis including:

an indoor part including an air inlet hole at a bottom wall of the indoor part, the air inlet hole penetrating the chassis in a thickness direction of the indoor part; and an outdoor part arranged relative to the indoor part along a length direction of the chassis, the outdoor part including a drain hole and an overflow hole that are spaced apart from each other and penetrate the chassis in a same direction; and a water receiving tray provided at the indoor part and including an avoidance hole corresponding to and in communication with the air inlet hole;

wherein:

an avoidance groove is provided at a lower surface of the chassis, recessed upward, and extends along the length direction of the chassis;

a support arm is mounted to the lower surface and received in the avoidance groove, the support arm being configured to connect the chassis to a wall; and the overflow hole, the drain hole, and the avoidance groove are arranged along the length direction of the chassis.

18. The window air conditioner according to claim 17, further comprising:

a face frame connected to a side of the indoor part facing away from the outdoor part, an end of a bottom wall of the face frame close to the indoor part abutting against a side wall of the indoor part, and a side wall of the face frame being spaced apart from the side wall of the indoor part.

19. The chassis according to claim 1, wherein:

the overflow hole, the drain hole, and the avoidance groove are arranged sequentially along the length direction of the chassis.

20. The chassis according to claim 1, wherein:

the drain hole and the overflow hole penetrate the chassis in the same direction that is parallel to the thickness direction of the indoor part and perpendicular to the length direction of the chassis.

* * * * *